US011499388B2

(12) United States Patent
Papadimitriou et al.

(10) Patent No.: US 11,499,388 B2
(45) Date of Patent: Nov. 15, 2022

(54) AUTONOMOUS BLOWOUT PREVENTER

(71) Applicants: Wanda Papadimitriou, Houston, TX (US); Jason A Papadimitriou, Houston, TX (US); Nicholas A Papadimitriou, Houston, TX (US)

(72) Inventors: Stylianos Papadimitriou, Houston, TX (US); Wanda Papadimitriou, Houston, TX (US); Jason A Papadimitriou, Houston, TX (US); Nicholas A Papadimitriou, Houston, TX (US)

( * ) Notice: Subject to any disclaimer, the term of this patent is extended or adjusted under 35 U.S.C. 154(b) by 134 days.

(21) Appl. No.: 17/012,443

(22) Filed: Sep. 4, 2020

(65) Prior Publication Data

US 2020/0399974 A1 Dec. 24, 2020

Related U.S. Application Data

(63) Continuation-in-part of application No. 16/176,281, filed on Oct. 31, 2018, now Pat. No. 10,767,438, which is a continuation-in-part of application No. 15/134,745, filed on Apr. 21, 2016, now Pat. No. 10,145,198.

(60) Provisional application No. 62/151,627, filed on Apr. 23, 2015.

(51) Int. Cl.

| | |
|---|---|
| ***E21B 33/064*** | (2006.01) |
| ***E21B 21/08*** | (2006.01) |
| ***E21B 21/00*** | (2006.01) |
| ***E21B 33/035*** | (2006.01) |

(52) U.S. Cl.

CPC ..... *E21B 33/064* (2013.01); *E21B 21/001* (2013.01); *E21B 21/08* (2013.01); *E21B 33/0355* (2013.01)

(58) Field of Classification Search

CPC ..... E21B 33/064; E21B 21/001; E21B 21/08; E21B 33/0355; E21B 33/063

See application file for complete search history.

(56) References Cited

U.S. PATENT DOCUMENTS

| | | | | |
|---|---|---|---|---|
| 5,398,761 | A * | 3/1995 | Reynolds | E21B 33/064 166/344 |
| 6,044,690 | A * | 4/2000 | Williams | E21B 33/063 73/49.1 |
| 7,082,822 | B2 * | 8/2006 | Harthorn | G01N 29/28 73/598 |
| 7,779,917 | B2 * | 8/2010 | Kotrla | E21B 33/076 166/85.4 |
| 8,376,051 | B2 * | 2/2013 | McGrath | E21B 33/06 166/347 |
| 8,720,579 | B2 * | 5/2014 | Reynolds | E21B 33/064 166/85.4 |

(Continued)

*Primary Examiner* — Ramesh B Patel

(74) *Attorney, Agent, or Firm* — Kenneth L. Nash

(57) ABSTRACT

An autonomous BOP system is provided for stopping an uncontrolled flow of formation hydrocarbons comprising two or more sensors distributed along a length of a subsea blowout preventer to monitor a drill pipe inside a blowout preventer and measure critical parameters. A computer using predictive-software monitors a blowout preventer along with material critical parameters and calculates a blowout preventer configuration and sequence to arrest a well blowout. Blowout preventer components are fine-tuned and operational modes are added to aid an arrest of a well blowout under realistic conditions.

19 Claims, 11 Drawing Sheets

(56) References Cited

U.S. PATENT DOCUMENTS 8,781,743 B2 * 7/2014 McKay ..... E21B 33/064 702/9
9,145,761 B2 * 9/2015 Hallundbaek ..... E21B 33/076
9,322,763 B2 * 4/2016 Papadimitriou ..... G01B 5/14
9,347,289 B2 * 5/2016 Judge ..... E21B 33/063
9,658,130 B2 * 5/2017 Veeningen ..... E21B 33/064
9,989,975 B2 * 6/2018 Holmes ..... G05B 15/02
10,145,198 B2 * 12/2018 Papadimitriou ..... E21B 33/06
10,767,438 B2 * 9/2020 Papadimitriou ..... E21B 33/064
2005/0055163 A1 * 3/2005 Hopper ..... E21B 47/09 702/6
2009/0056936 A1 * 3/2009 McCoy, Jr. ..... E21B 43/013 166/250.01
2009/0194290 A1 * 8/2009 Parks ..... E21B 33/0355 166/344
2012/0197527 A1 * 8/2012 McKay ..... E21B 33/064 702/6
2012/0217017 A1 * 8/2012 Zediker ..... E21B 29/12 166/363
2012/0274475 A1 * 11/2012 Milne ..... E21B 21/08 340/853.1
2013/0153241 A1 * 6/2013 Mallinson ..... E21B 33/061 166/363
2013/0206419 A1 * 8/2013 Hallundbaek ..... E21B 47/001 166/341
2013/0221250 A1 * 8/2013 Judge ..... F16K 37/0025 137/554
2014/0000902 A1 * 1/2014 Wolfe ..... E21B 29/00 166/361
2014/0064029 A1 * 3/2014 Jaffrey ..... E21B 33/0355 367/81
2014/0123746 A1 * 5/2014 Jaffrey ..... G01S 13/878 73/152.18
2016/0138355 A1 * 5/2016 Rytlewski ..... E21B 33/064 166/336
2017/0089163 A1 * 3/2017 Vitou ..... E21B 47/095
2018/0073320 A1 * 3/2018 Holmes ..... F15B 1/02
2018/0371840 A1 * 12/2018 Cummins ..... E21B 23/02

* cited by examiner

Centered Drillpipe Configuration

BOP Wall

Mid-Way

BOP Wall

Closed

BOP Wall

Buckled Drillpipe Configuration

BOP Wall

Mid-Way

BOP Wall

Closed

BOP Wall

AUTONOMOUS BLOWOUT PREVENTER

BACKGROUND OF THE INVENTION

Field of the Invention

This invention relates, generally, to blowout preventers for subsea applications, and more specifically, to an autonomous blowout preventer to monitor the material inside the blowout preventer and measure the critical parameters for performance of the blowout preventer.

Description of the Prior Art

Formation hydrocarbons (kick) may flow into a well during drilling, thereby "kicking" or displacing the drilling fluids. The rig crew must watch for a kick and shut-in the well before it evolves into a blowout as illustrated in FIG. 2. Early appropriate intervention is the best solution as a kick may evolve rapidly resulting in a short window of opportunity to arrest the blowout and bring the well under control.

The Blowout Preventer, also referred to herein as "BOP", comprises a number of valves and it is placed on top of a well to facilitate daily operations and act as the last line of defense against the uncontrolled flow of hydrocarbons. However, the history of BOP performance during a well blowout and scrutiny of BOP designs reveal that BOP's are designed more as Operation-Aids for a well that is under control; not as Blowout-Arrestors to prevent the uncontrolled flow of hydrocarbons as illustrated in FIG. 6A-FIG. 6F. Well operations are static or quasi-static under the control of the rig crew while a well blowout is a forceful dynamic event, often beyond the control of the rig crew and beyond the capabilities of today's BOP designs. This has resulted in a number of disasters, like IXTOC 1 and MACONDO, resulting in environmental disasters and loss of life. As opposed to daily well operations, the appropriate blowout action cannot be established without real-time feedback of critical parameters followed by a calculated rapid response.

Therefore, there is a need to define the BOP distinct functions; to correct the BOP design deficiencies; to monitor critical parameters to identify a kick early-on; to track the kick evolution and to optimize the BOP operation and sequencing to arrest the event under the various realistic conditions to bring the well under control. The last line of defense should be a Blowout-Arrestor, not an Operations-Aid. It should be understood that a seaworthy Blowout-Arrestor may function as a seaworthy Operations-Aid, but not the other way around as experience has proven.

BOP DESIGN OVERSIGHTS, ERRORS and OMISSIONS

Again, BOPs today are designed as Operation-Aids, not as Blowout-Arrestors. It is reasonable then to conclude that the probability that an Operations-Aid would seal off a well during a blowout is very low with luck being the controlling factor. Luck is not a measure of fitness-for-service or seaworthiness, although good luck is always invaluable. The Macondo investigation has accepted the June 2003 successful EDS (a rig crew controlled operation) as proof that the BOP was designed properly and has focused on the Deepwater Horizon BOP maintenance and record keeping, even challenging the maintenance means and methods of the rig owner.

Quoting from the Chief Counsel's Report "MMS regulation 30 C.F.R. § 250.446(a) requires that the BOPs be inspected according to API RP 53 . . . and (the manufacturer) would certify that the inspections were completed". There are multiple fallacies associated with this Code that significantly undermine safety.

First, the Code assumes that "Inspection" and "Seaworthiness" are the same; a failure root-cause. "Inspection" is defined as "to look at something" and it is undefined on its own. "Seaworthiness" on the other hand, is the result of a specific Fitness-For-Service-Engineering-Assessment. "Inspection" is well defined only as a part of a Seaworthiness-Engineering-Assessment where it is required to produce a number of high-quality specific data to facilitate the Seaworthiness-Engineering-Assessment. The Code should be updated to require a Seaworthiness certificate, preferably issued by a qualified third party as it is required for all other seagoing vessels and equipment.

The Code relies on the manufacturer (who made the design assumptions in the first place) for the "Inspection" of the drilling equipment and therefore, the Code guarantees that the design and manufacturing errors and oversights will not be noticed or be corrected. Recently, it was revealed that an auto manufacturer ignition-switch design oversights, errors and omissions disabled the automobile steering and the airbags. It should be noted that the ignition-switch in question was "inspected" to the manufacturer's specifications and standards prior to assembly into a new car, and yet, it was unfit-for-service.

The Code requires the manufacturer to only certify that an "Inspection" was performed. The manufacturer's certificate-of-compliance, herein after referred to as "COC", certifies that the manufacturer performed an "Inspection". The COC however, does not include the specifics and the finding of the inspection; does not certify that the equipment is Seaworthy; does not certify that the BOP is Fit-For-Subsea-Service or that the BOP is fit to contain a well blowout under realistic blowout conditions and so on and so forth.

Therefore, there is an additional need to certify that all the drilling equipment is Seaworthy under realistic conditions following a Seaworthiness-Engineering-Assessment that is applicable across the board of subsea products and manufacturers.

BOP Maintenance

Regardless of what a COC certifies, a COC is part of a maintenance program. Maintenance cannot correct design errors and oversights or prevent a misapplication. For example, the Deepwater Horizon BOP shear rams were designed under the EDS assumptions (see FIG. 6A-6F caption—"the Deepwater Horizon BOP was designed to shear centered drill pipe . . . "). There is no maintenance that can correct these design assumptions. Despite the June 2003 EDS success, the Deepwater Horizon BOP failed to arrest and control the April 2010 Macondo well blowout simply because it was not designed as a Seaworthy Blowout-Arrestor, a design flaw that maintenance cannot correct regardless of whom, where, when or how the maintenance was performed or how well it was documented or how current was the manufacturers COC or even, if there was a COC ever issued. API S53 (7.6.11.7.2) "it is important to understand the equipment designs, their application/use, and those components run in the wellbore and the BOP/control systems in use". The fact that the Deepwater Horizon BOP functioned as designed in the June 2003 EDS is adequate proof that it was maintained properly all along but it is not proof that it was designed as a Seaworthy Blowout-Arrestor.

Based on the above fallacies, there are a number of decisions that allocate serious blame to different companies and individuals but not to the root-cause of the failure, the BOP design. However, if the BOP was designed and functioned as a Seaworthy Blowout-Arrestor the rest of the Macondo failures and oversights would have been irrelevant. It would not matter how the cement was mixed; it would not matter how many centralizers were used; it would not matter how the pressure readings were interpreted; it would not matter who send a text to whom; it would not matter how the maintenance was documented and so on and so forth. After all, the primary reason a BOP is deployed is to make all other mistakes irrelevant and prevent a disaster.

Similarly, if the automobile steering was not disabled by a bad ignition-switch design the accidents would not have happened and if the airbags were not disabled at the same time people may have not died. The automobile accidents were not the fault of the imprisoned drivers just like the Macondo was not the fault of the operator, its partners and the subcontractors; all unaware that their last line of defense was a dud. To make things worse, the lengthy Macondo investigation, prosecution and new Codes have further reduced safety because the root-cause of the disaster was missed entirely and it is still deployed dangerously as the last-line of defense.

Therefore, there is a further need for a BOP design to arrest and restraint a well blowout along with an adaptable BOP controller and software that monitors the kick evolution using predictive-intelligence to adjust the BOP response and sequencing. It should be noted that the BOP controller and software would rely on in-depth knowledge of the BOP design and therefore some design and manufacturing errors and oversights will be detected during the BOP analysis to implement the BOP controller software. Again, in-depth knowledge of the BOP (and the other drilling equipment) is also required by API S53 (7.6.11.7.2).

The non-obviousness of the present invention is clearly demonstrated by the Investigation Reports and the Federal Court findings and conclusions associated with the Macondo Well Blowout and the sinking of the Transocean Deepwater Horizon rig.

The following reports are incorporated herein by reference and form a part of the disclosure advanced by Applicant:

MACONDO—DEEPWATER HORIZON Investigation Reports

- Final Report, Deepwater Horizon Joint Investigation Team: September 2011
- Deepwater Horizon Accident Investigation Report—BP: September 2010
- Macondo Well Incident—Transocean Internal Investigation (Public Report): June 2011
- Macondo, The Gulf Oil Disaster—Chief Councils Report: February 2011
- Deepwater Horizon Study Group (DHSG)—Final Report: March 2011
- Deepwater Horizon Casualty Investigation Report—Republic of the Marshall Islands, Office of Maritime Administrator: August 2011
- DNV Report on Deepwater Horizon BOP to U.S. BOEMRE: March 2011
- Macondo Well, Deepwater Horizon Blowout—National Academy of Engineering and National Research Council: National Academies Press—December 2011
- Investigation Report: Explosion and Fire at the Macondo Well—US Chemical Safety and Hazard Investigation Board: June 2014

REFERENCES

API Standard 53 Blowout Prevention Equipment Systems for Drilling Wells—4$^{th}$ Edition BSEE Effects of Water Depth Workshop: Galveston, Tex.—November 2011

SUMMARY OF THE INVENTION

It is a general purpose of the present invention to provide an improved BOP monitoring system and method.

An object of the present invention is to provide an improved monitoring system that may be utilized in pressure control equipment such as wellheads and BOPs to arrest a well blowout.

Another object of the present invention predictive-intelligence system monitors the BOP and drill pipe to recognize early on a well blowout and to adjust the BOP sequencing and timing to arrest and restrain the well blowout in the early stages.

Accordingly, the present invention provides a system of one or more computers that can be configured to perform particular operations or actions by virtue of having software, firmware, hardware, or a combination of them installed on the system that in operation causes or causes the system to perform the actions. One or more computer programs can be configured to perform particular operations or actions by virtue of including instructions that, when executed by data processing apparatus, cause the apparatus to perform the actions.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

One general aspect includes a system for a subsea bop, the subsea bop defining a bore through the subsea bop, the subsea bop including two bop rams, the two bop rams including a shear ram, the shear ram including two pistons and two piston rods, an accumulator to stroke the two shear ram pistons associated with the shear ram, the subsea bop being operable to receive a string of pipe moveable within the bore, the system including: a subsea computer, the one computer being operatively connected to the two bop rams and the accumulator and the subsea computer; a pressure intensifier connected to vary a force applied to the two pistons; subsea sensors in the subsea bop to monitor a speed and position of the two piston rods; subsea sensors around the subsea bop to monitor the string of pipe and determine when the string of pipe is off-center in the bore; the computers programmed to control an activation timing of the two bop rams, the computer being operable to estimate a shear force to cut the string of pipe; and a pressure intensifier connected to vary a force applied to the two pistons responsive to the estimate of the shear force required to cut the string of pipe. Other embodiments of this aspect include corresponding computer systems, apparatus, and computer programs recorded on one or more computer storage devices, each configured to perform the actions of the methods.

Implementations may include one or more of the following features. The system further including: the subsea sensors being operable to detect cable inside said string of pipe;

sensors to detect two or more of drill pipe internal pressure, a temperature gradient between seawater and well fluids, compression or tension of a body wall of the string of pipe inside the shear ram, or flow of fluid through the string of pipe, the computers programmed to estimate a change in the shear force to cut the string of pipe. The system further including the computer being programmed to detect and store information for each pipe in the string of pipe, the information includes wall thickness, hardness, and dimensions. The system where the computers programmed to update the information over time as the string of pipe is moved through the subsea bop. The system where the computer stores in some detail the information to determine in some detail a shearing force for each pipe. The system where the computers programmed to measure a speed and an acceleration of the piston rod and determine when a shear is complete. The system where the computers programmed to measure a speed and an acceleration of the piston rods and determine if the speed and acceleration is decreasing to an extent to predict that a shear will not be made. The system further including the computers programmed to initiate a hammer operation of the two pistons to aid tearing a drill pipe through cumulative fatigue. The system further including the computers programmed to control the hammer operation utilizing the pressure intensifier to pulse hydraulic fluid to the two pistons. The hammer operation results in oscillations of the shear ram cutting components such as pistons, piston rods, shear elements, and the like. The system further including sensors in the subsea bop to detect RFID chips embedded in the string of pipe, the computers programmed to use previous inspection data to determine an amount of force to cut a particular pipe in the string of pipe based on information stored in an RFID for the particular pipe. The system further including the computers programmed to do a pipe tally as the string of pipe moves through the subsea bop. The system where the computer is programmed to control which of the two BOP rams to operate first. The system further including a plurality of groups of sensors circumferentially spaced around the subsea bop, a plurality of groups of sensors with a group of sensors being positioned at each of a plurality of different axial positions along the bore through the subsea bop. The system further including a warning system, said warning system including one or more of a smart device or wearable to provide an audible alert in natural language, a tactile alarm, or a visual alarm. The system where once a warning is given and no action is taken after a set amount of time, then an automated blowout prevention is initiated. The system where the computers programmed to monitor a time interval between tool joints passing through a plurality of groups of sensors to provide a speed of the tool joints passing through the subsea bop and also to determine a direction of the tool joints passing through the subsea bop. The system where the computer is programmed to detect motors, drill bits, bottom hole assembly components, wireline, monitoring equipment, tools, or a variety of other items. The system further including an onshore monitor connected to the computer to monitor BOP status. Implementations of the described techniques may include hardware, a method or process, or computer software on a computer-accessible medium.

One general aspect includes a monitoring system for a subsea BOP, the subsea BOP defining a wellbore through the wellbore, the subsea BOP including at least two BOP rams, the at least two BOP rams including a shear ram, the at least two BOP rams further includes at least two pistons which further include a shear ram piston, at least one accumulator to stroke the shear ram piston associated with the shear ram, a string of pipe moveable within the wellbore, the string of pipe including a plurality of pipe connectors and a plurality of pipe bodies between the pipe connectors, the well monitoring system including: at least one subsea computer, the at least one computer being operatively connected to the at least two BOP rams and the at least one accumulator and the at least one subsea computer; and software operable on the at least one computer to control an activation timing of the at least two BOP rams to control the subsea BOP. Other embodiments of this aspect include corresponding computer systems, apparatus, and computer programs recorded on one or more computer storage devices, each configured to perform the actions of the methods.

Implementations may include one or more of the following features. The system further including: at least one subsea sensor; a sensor subsea interface; a communications link; and where the software further includes a module which monitors a plurality of material parameters of a string of pipe inside the subsea BOP. The system where the plurality of material parameters includes wall thickness. The system where the at least one subsea sensor further includes a plurality of sensors circumferentially spaced around the subsea BOP. The system further including the plurality of sensors being positioned outside of the wellbore through the subsea BOP. The system further including a plurality of groups of the plurality of sensors circumferentially spaced around the subsea BOP, at least two groups of sensors being positioned at different heights of the subsea BOP with respect to the wellbore through the subsea BOP, the sensors being operable to detect relative positions of the string of pipe within the subsea BOP at each of the different heights. The system where software is operable to utilize signals from the at least one subsea sensor to indicate when a pipe body from the plurality of pipe bodies is positioned adjacent the shear ram. The system where the software is operable to control the activation timing to initiate cutting the string of pipe independently of a surface control. The system where the software is operable to control the activation timing to control which of the at least two BOP rams to operate first. The system where the software is operable to utilize signals from the at least one subsea sensor to provide an alert to the surface that well control has been at least potentially compromised. The at least one accumulator further including at least one pressure intensifier operatively connected to vary a force applied to the shear ram piston. The at least one accumulator further including at least one valve controlled by the at least one subsea computer. The monitoring system further including: software for the computer to compute when the pipe body is located at the shear ram. The monitoring system further including: software to determine a force necessary to cut the string of drill pipe with the shear ram where the force varies. The monitoring system further including: the software being operable to control the force to cut the string of drill pipe. The monitoring system further including an intensifier operably connected to selectively increase the force in response to the software. The plurality of parameters further including of wall thickness, imperfections hardness, dimensions, wear, rate of wear, stress concentration, weight, lateral location, angle, similar items and a combination thereof. The one computer further including a surface data acquisition system operable to monitor surface detected operation parameters, the surface data acquisition system being operatively connected to the at least one subsea computer. The plurality of parameters further including of one or more of capacitance, contactivity, current, deflection, density, external pressure, fluid volume, flow rate, frequency, impedance, inductance, internal pressure, length, accumulator pressure, resistance, sound, temperature, vibration, voltage, and combinations thereof. Implementations of the described techniques may include hardware, a method or process, or computer software on a computer-accessible medium.

One general aspect includes a monitoring system for a subsea BOP defining a wellbore through the subsea BOP in which a string of drill pipe is moveable, the string of drill pipe string including a plurality of drill pipe connectors and a plurality of pipe bodies between the drill pipe connectors, the subsea BOP including a plurality of rams including a pipe ram and a shear ram, including: a computer operatively connected to control opening and closing of the plurality of rams; and a plurality of groups of sensors, each group of sensors being mounted circumferentially around the subsea BOP, at least two groups of sensors being positioned at different heights of the subsea BOP with respect to the wellbore through the subsea BOP, the computer being operable to utilize the plurality of groups of sensors to detect positions of respective of the plurality of pipe bodies and the plurality of drill pipe connectors within the subsea BOP at each of the different heights. Other embodiments of this aspect include corresponding computer systems, apparatus, and computer programs recorded on one or more computer storage devices, each configured to perform the actions of the methods.

Implementations may include one or more of the following features. The monitoring system further including: software for the computer to compute when the pipe body is located proximate to the shear ram. The monitoring system further including: software to determine a force necessary to cut the string of drill pipe with the shear ram where the force varies. The monitoring system further including: the software being operable to control the force to cut the string of drill pipe. The monitoring system further including an intensifier operably connected to selectively increase the force in response to the software. The plurality of parameters further including of wall thickness, imperfections hardness, dimensions, wear, rate of wear, stress concentration, weight, lateral location, angle, similar items and a combination thereof. The at least one computer further including a surface data acquisition system operable to monitor surface detected operation parameters, the surface data acquisition system being operatively connected to the at least one subsea computer. The plurality of parameters further including of one or more of capacitance, contactivity, current, deflection, density, external pressure, fluid volume, flow rate, frequency, impedance, inductance, internal pressure, length, accumulator pressure, resistance, sound, temperature, vibration, voltage, and combinations thereof. Implementations of the described techniques may include hardware, a method or process, or computer software on a computer-accessible medium.

One general aspect includes a monitoring system for a subsea BOP, the subsea BOP defining a wellbore through the wellbore, the subsea BOP including at least two BOP rams, the at least two BOP rams including a shear ram, the at least two BOP rams further includes at least two pistons which further include a shear ram piston, at least one accumulator to stroke the shear ram piston associated with the shear ram, a string of pipe moveable within the wellbore, the string of pipe including a plurality of pipe connectors and a plurality of pipe bodies between the plurality of pipe connectors, the well monitoring system including: at least one computer with at least one sensor to monitor a plurality of parameters of the string of pipe inside the subsea BOP; and a program being executed on the at least one computer to initiate an activation of the shear ram to cut the string of pipe, the activation partially controlled by the plurality of parameters. Other embodiments of this aspect include corresponding computer systems, apparatus, and computer programs recorded on one or more computer storage devices, each configured to perform the actions of the methods.

Implementations may include one or more of the following features. The system the plurality of parameters further including of wall thickness, imperfections hardness, dimensions, wear, rate of wear, stress concentration, weight, lateral location, angle, similar items and a combination thereof. The system the at least one computer further including a surface data acquisition system operable to monitor surface detected operation parameters, the surface data acquisition system being operatively connected to the at least one subsea computer. The system the plurality of parameters further including of one or more of capacitance, contactivity, current, deflection, density, external pressure, fluid volume, flow rate, frequency, impedance, inductance, internal pressure, length, accumulator pressure, resistance, sound, temperature, vibration, voltage, and combinations thereof. Implementations of the described techniques may include hardware, a method or process, or computer software on a computer-accessible medium.

BRIEF DESCRIPTION OF THE DRAWINGS

For a further understanding of the nature and objects of the present invention, reference should be had to the following detailed description, taken in conjunction with the accompanying drawings, in which like elements may be given the same or analogous reference numbers and wherein.

While the present invention will be described in connection with presently preferred embodiments, it will be understood that it is not intended to limit the invention to those embodiments. On the contrary, it is intended to cover all alternatives, modifications, and equivalents included within the spirit of the invention.

DETAILED DESCRIPTION OF THE PRESENT INVENTION

Figure 1A:
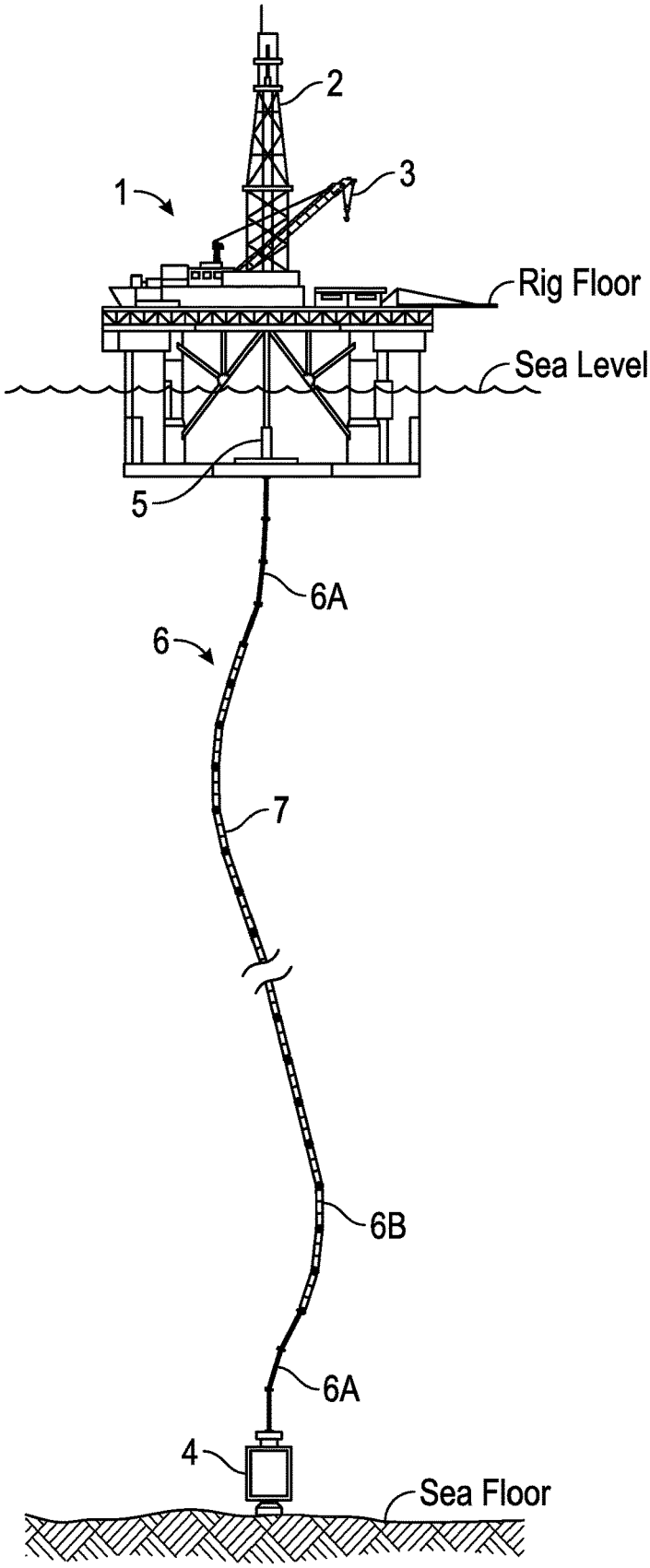
FIG. 1A is an elevation view of a floating drilling rig and deployed drilling equipment in accord with one possible embodiment of the present invention.

Referring now to the drawings and more particularly to FIG. 1A, a drill pipe joint and a drill string will be used in the following examples as the material inside the BOP when discussing AutoBOP 40. However, the examples are applicable to other Oil-Country-Tubular-Goods, herein after referred to as "OCTG", and the various combinations and configurations thereof. OCTG includes, but is not limited to casing, coiled tubing, drill pipe, marine drilling risers or risers, pipeline, tubing, and the like. It should also be understood that other tools and cables maybe inside or deployed along with the drill string to facilitate well operations and therefore, sealing the well would require shearing capabilities above those required for a drill pipe nominal body-wall only.

Figure 1B:
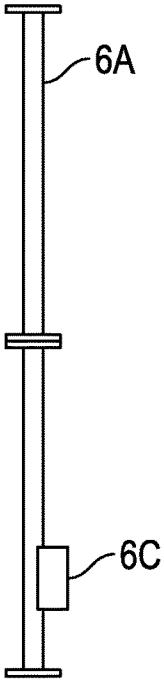
FIG. 1B is an elevation view of a drilling riser without buoyancy and instrumentation in accord with one possible embodiment of the present invention.
Figure 1C:
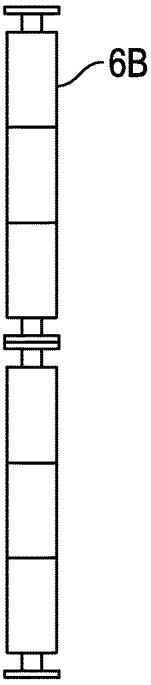
FIG. 1C is an elevation view of a drilling riser with buoyancy in accord with one possible embodiment of the present invention.

FIG. 1A depicts floating drilling rig 1 at a surface position comprising derrick 2, crane 3, and riser string 6 extending to subsea BOP 4. For illustration purposes, riser string 6 further comprises telescopic joint 5, Riser joints without buoyancy 6A, riser joints with buoyancy 6B and riser joints with instrumentation 6C. Riser joints with buoyancy 6B will be described in more detail in FIG. 1C and riser joints with instrumentation 6C shown in more detail in FIG. 1B. Drill pipe 7 is suspended from the derrick 2 and is deployed inside the Riser 6 main tube. It should be noted that land rigs employ similar equipment without the Riser 6 which extends the wellbore to the Rig 1.

Figure 2:
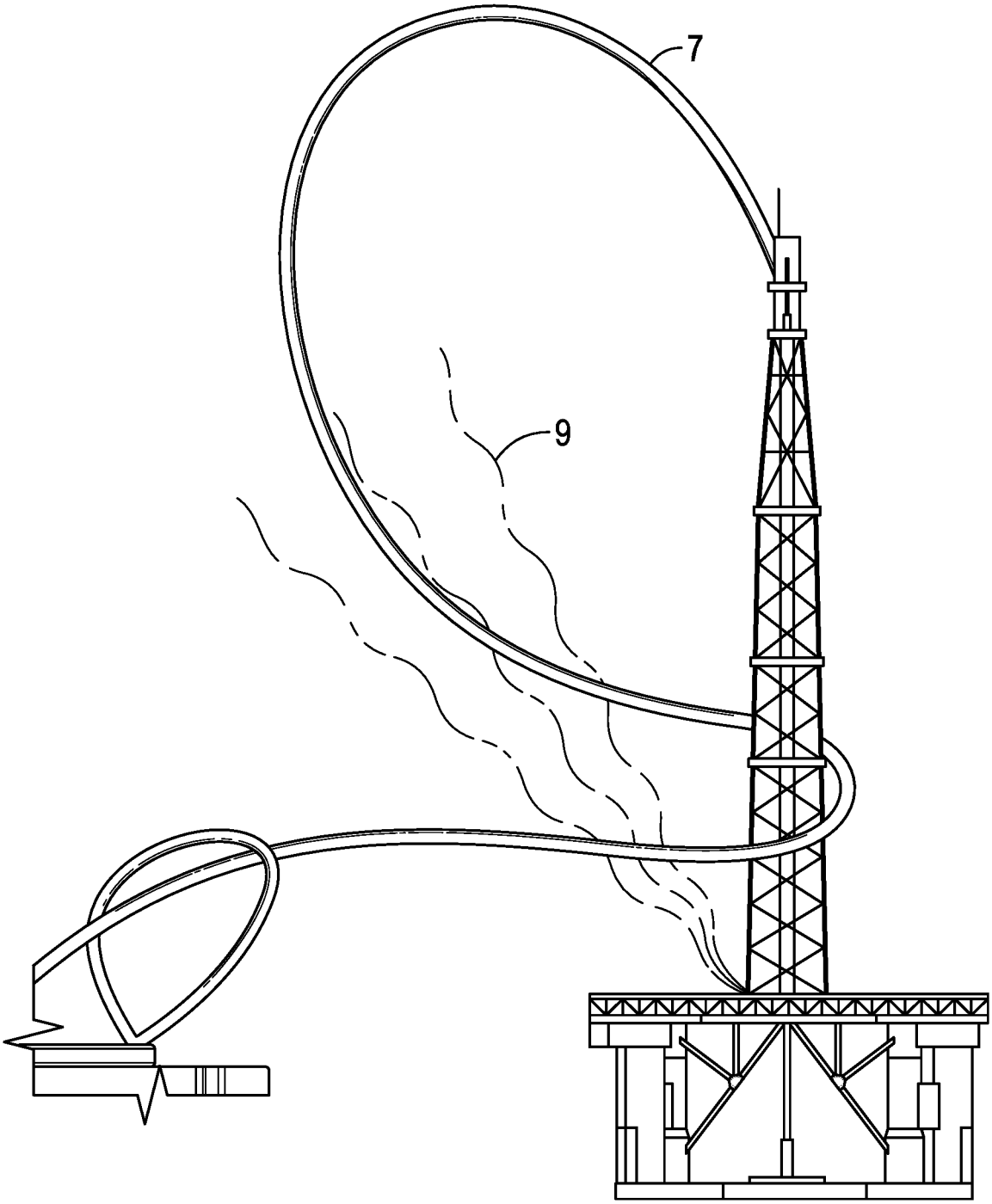
FIG. 2 (Prior Art)
FIG. 2 is an elevation view of a surface well blowout.

FIG. 2 illustrates a well blowout ejecting hydrocarbons 9 and the drill pipe 7 at high speed well above the derrick 2 before gravity bends the drill pipe 7. The well blowout is an unpredictable forceful dynamic event that can only be arrested and controlled by real-time monitoring of critical parameters that lead to a rapid calculated response.

DESCRIPTION OF A SIMPLE SUBSEA BOP STACK

Figure 3:
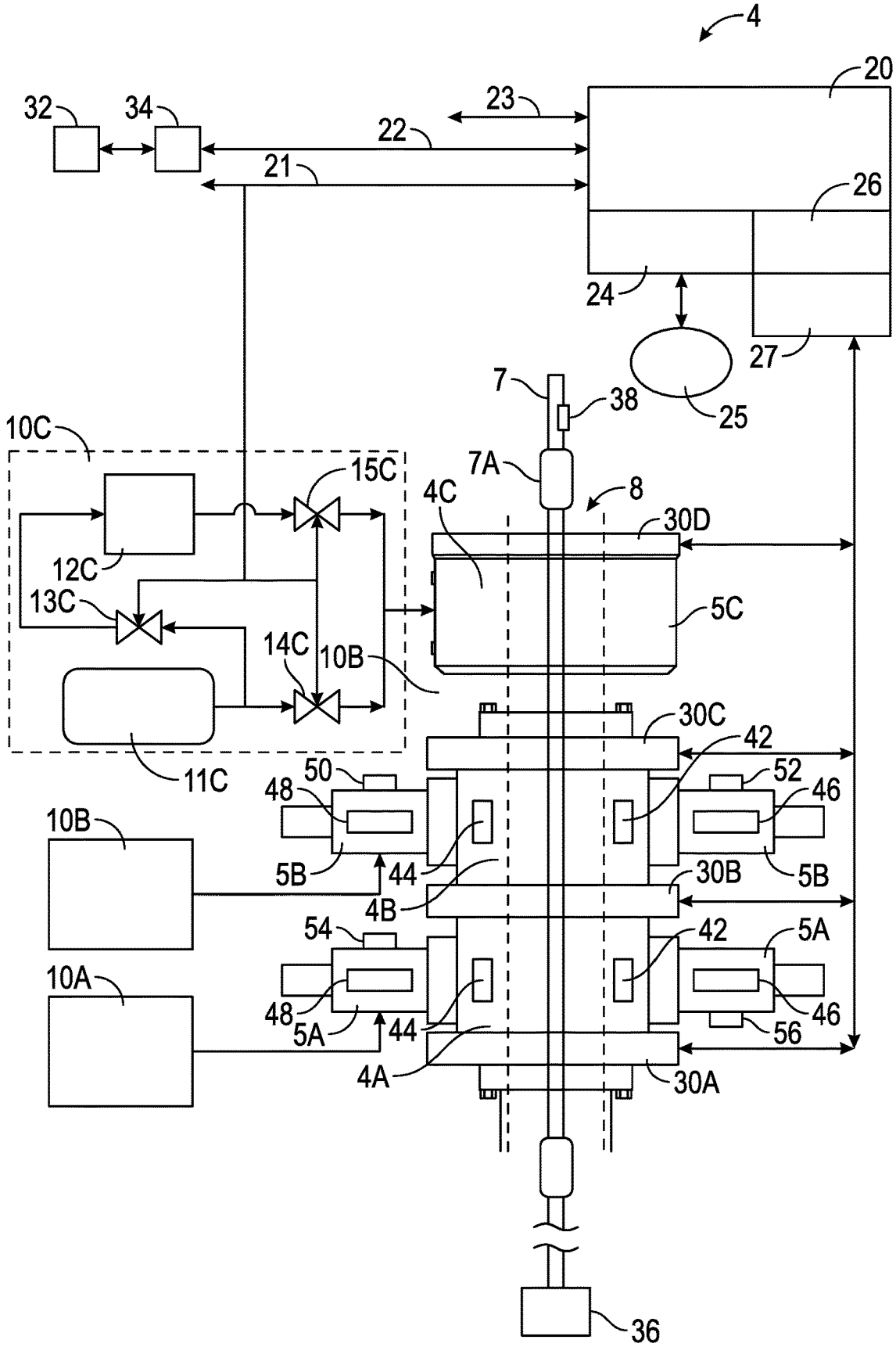
FIG. 3 illustrates a subsea blowout preventer in accord with one possible embodiment of the present invention.

Turning now to FIG. 3, one embodiment of the present invention is illustrated. The present invention Autonomous BOP, or AutoBOP 4 (see also FIG. 1), described hereinbelow is a machine designed to deliver successful results under every conceivable scenario and within a short window of opportunity while operating in a dynamic environment and interacting with other dynamic machines, such as a drill pipe, a well, and various other equipment and combinations thereof. In other words, AutoBOP 4 is an "event-space-time problem" solver (herein after referred to as "Problem") that ordinarily would require the intellectual abilities of humans (event-space) if humans could react fast enough (time).

The AutoBOP operation environment is dynamic as is its interaction with the other dynamic machines. The operation environment Problem and the interaction Problem(s) never have a complete description and cannot be thoroughly predicted while they evolve or at the design phase or prior to deployment. Therefore, AutoBOP 4, through software of computer or predictive-controller 20, monitors and stores a sufficient number of parameters to represent the instantaneous real world Problems along with changes and trends in sufficient detail to solve the Problems it encounters. It should be understood that the solution(s) to the Problem(s) would most likely be dynamic, reacting to the environment and interaction changes that redefine the target. Only the target is well defined as the "delivery of successful results", or stated differently, the sealing of the well to stop the uncontrolled flow of the formation hydrocarbons. Therefore, AutoBOP needs to function on its own in its environment as a stand-alone system.

Subsea AutoBOP 4 may comprise a number of annular preventers 4C, rams 4A and 4B and accumulator systems 10A, 10B, and 10C. The BOP "Class" is the total number of annular preventers (designated as "A") and rams (designated as "R"), such as, Class 6-A2-R4. API S53 specifies the minimum subsea stack as a Class 5 comprising, at minimum, one annular, two pipe rams and two shear rams. For clarification, it should be noted that it is customary to describe BOP 4 from the bottom upwards and will be described accordingly herein. The FIG. 3 simple configuration of AutoBOP 4 comprises pipe ram 4A at the bottom, blind shear rams (herein after referred to as "BSR") 4B and annular preventer 4C at the top and it is sufficient for detailing the present invention. It should be understood that AutoBOP 40 shown in a simplified illustration is not intended to limit the scope of the present invention.

Accumulator systems 10A, 10B, 10C provide the hydraulic power to operate BOP 4, more specifically annular preventers 4C and shear ram 4B and pipe ram 4A. Accumulator system 10C further comprises pressure intensifier 12C, accumulator 11, and valves 13C, 12C, and 15C. Accumulator 11C is precharged at the surface, typically with nitrogen, to 3,000 psi at 20° C. for example. Accumulator 11C is then charged by the subsea hydraulic supply with sufficient volume of fluid to operate annular preventers 4C and rams 4A and 4B. The "Drawdown Test" (API S53 6.5.6.2) verifies that accumulator 11C is able to provide sufficient fluid volume and pressure to secure the well with final accumulator pressure of, at least, 200 psi above precharge pressure.

Valves 13C, 14C and 15C are controlled by computer 20 through peripheral-bus 21. Computer 20 may open or close valves 13C, 14C and 15C, either fully or partially. Computer 20 additionally monitors pistons 5 and the accumulator systems 10 via peripheral-bus 21. In other embodiments, accumulator system 10C may comprise a plurality of accumulator 11C, pressure intensifier 12C, valves 13C, 14C, 15C and similar components. It should further be understood that accumulator systems 10 comprise similar components as further illustrated in FIG. 10.

Figure 4:
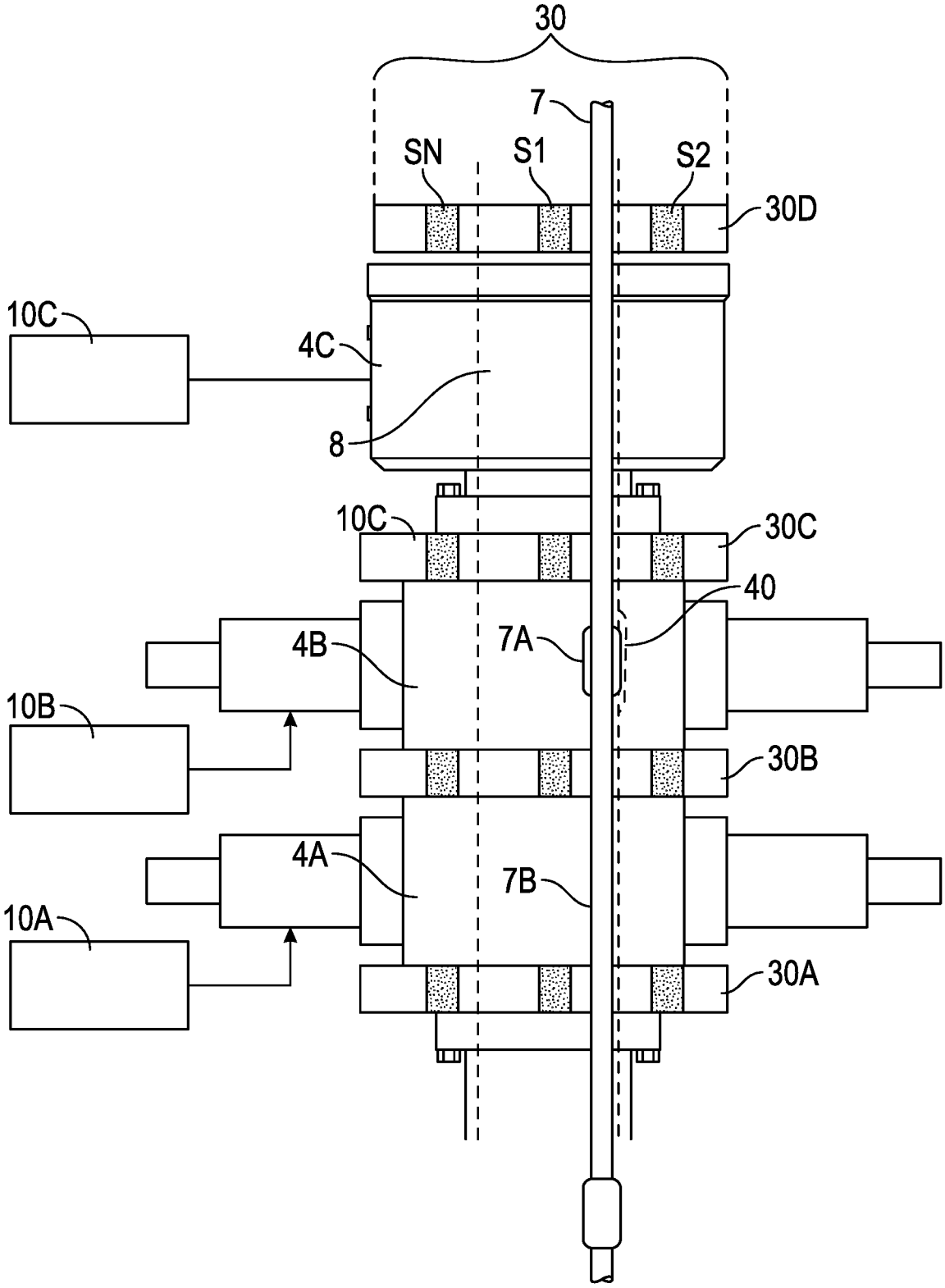
FIG. 4 depicts a subsea blowout preventer with sensor details in accord with one possible embodiment of the present invention.
Figure 7:
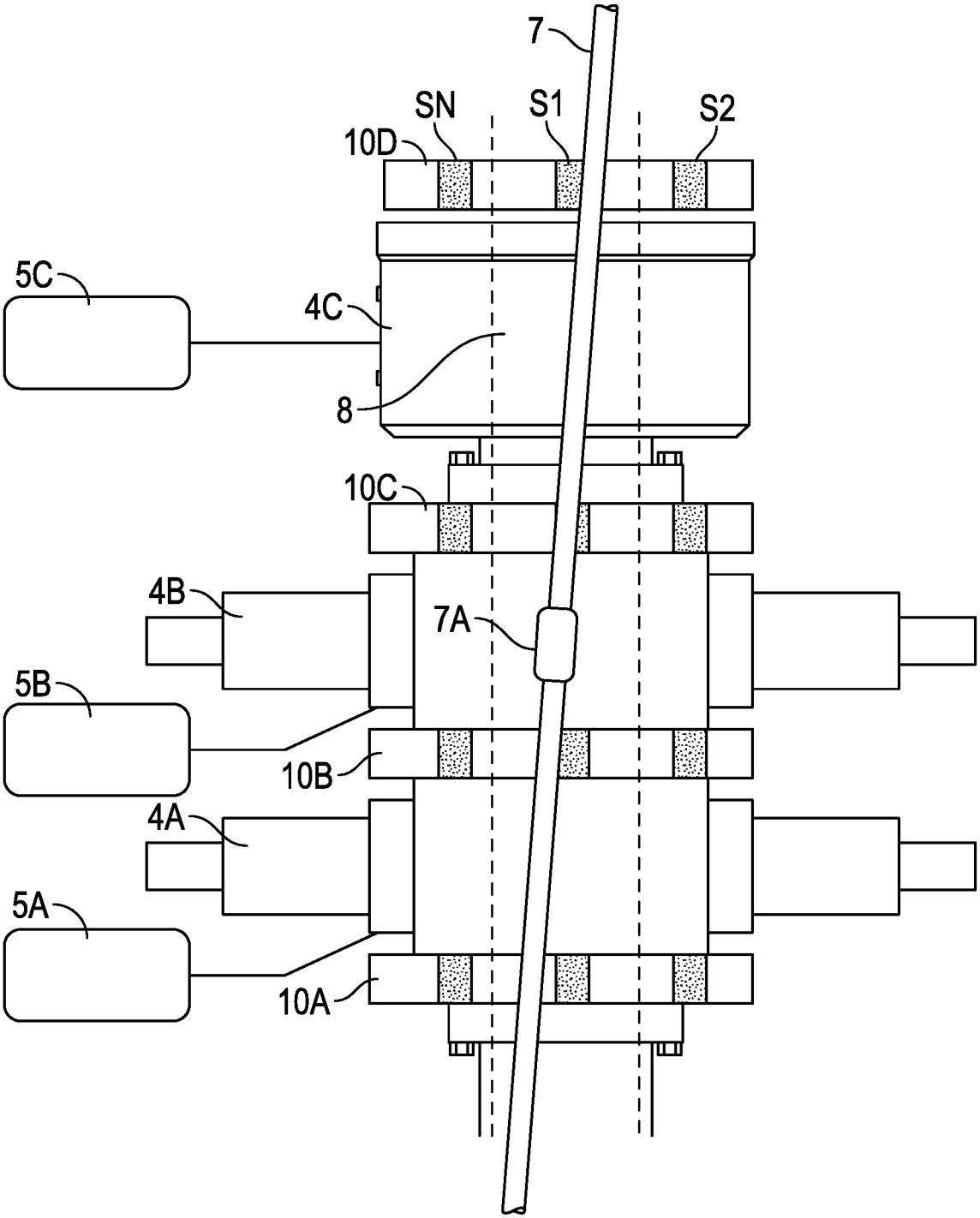
FIG. 7 illustrates an angled drill pipe through the BOP in accord with one possible embodiment of the present invention.
Figure 8:
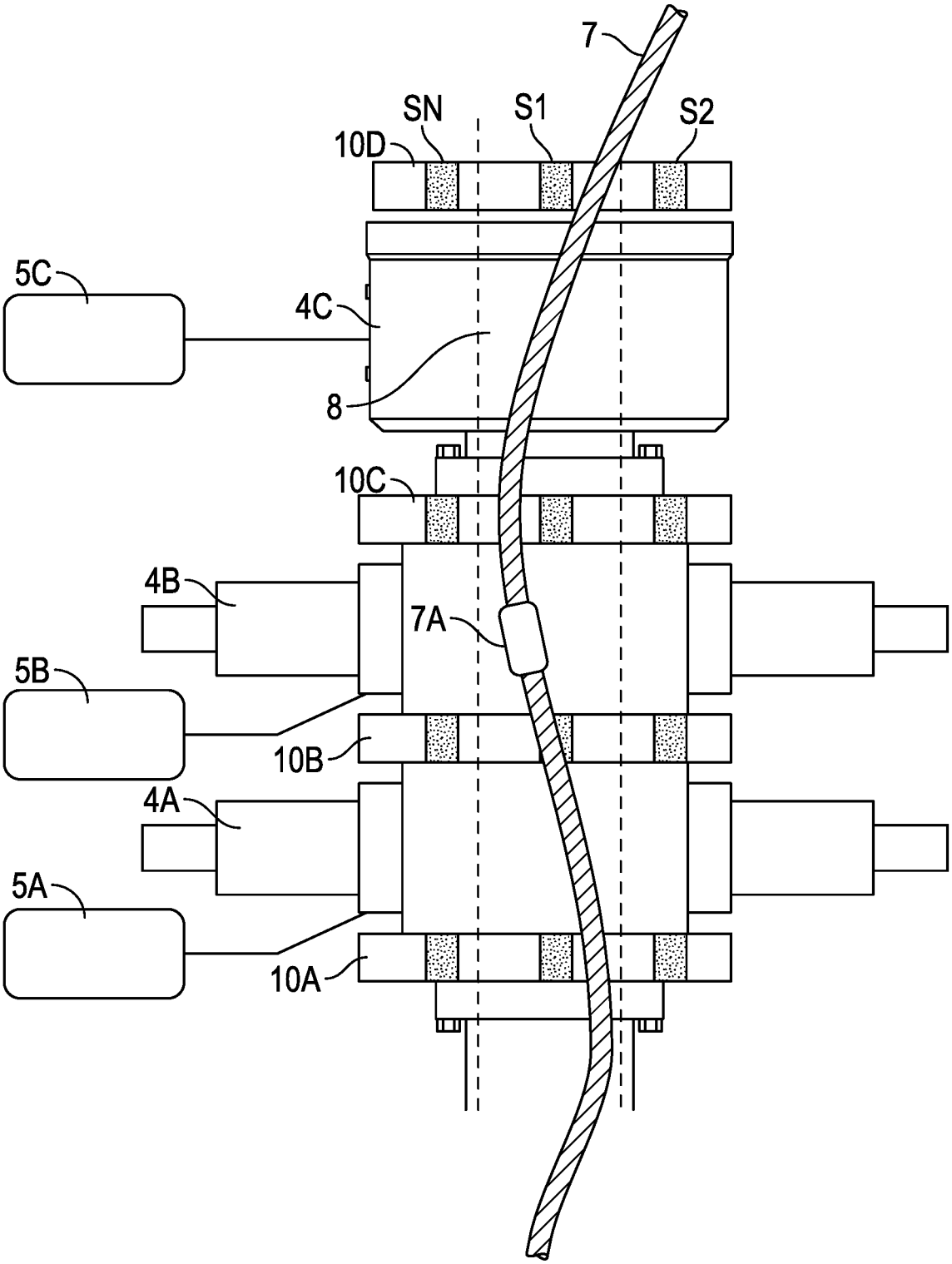
FIG. 8 illustrates a buckled or helically deformed drill pipe through the BOP in accord with one possible embodiment of the present invention.

A plurality of non-contact sensors 30 (See FIG. 5A) in groups 30A, 30B, 30C, and 30D are distributed along the length of BOP 4 to monitor annulus 8 of BOP 4 as depicted in FIG. 3 & FIG. 4. Each non-contact sensor 30A, 30B, 30C, and 30D further comprises sensors S1 through SN disposed around the circumference (See FIG. 4 and FIG. 5A) of annulus 8 where N represents the total number of sensors needed to completely surround annulus 8. In other words, groups of sensors 30A, 30B, 30C, and 30D (where each group comprises sensors S1-SN) are provided wherein a group of sensors may be provided at a plurality of different heights with respect to the wellbore through the BOP as shown in FIG. 3, FIG. 7, and FIG. 8. N may vary as desired depending on the diameter of the BOP. Sensors 30 are sufficient in number and type(s) to cover the monitoring needs, preferably including but not limited to, the OCTG parameters (wall thickness, imperfections, hardness, dimensions, wear, stress concentration, weight and similar items), especially including lateral location (offset from BOP 4 vertical centerline or proximity to BOP ID wall), angle (as illustrated in FIGS. 7 and 8), speed and direction of travel, similar items and combinations thereof. It should be understood that not all sensors 30 may be deployed or utilized at all times.

Sensor interface 27 processes the analog signals from sensor 30 and converts said analog signals to a digital format under the control of computer 20. Computer 20 further provides controlled excitation 26 to sensors 30. AutoBOP both stores and transmits through communication link 22 the Problems and solutions for real-time interaction with the rig crew and further examination at a later time. It should be noted that the stored data would advance the knowledge of the designer and the operator. Furthermore, AutoBOP allows for external BOP control through the power and communication subsea connector 23. Computer 20 takes into account all other monitored parameters through data acquisition system 24 and data acquisition sensors 25 to include with the real-time data.

A drill string is a dynamic machine that interacts with AutoBOP 40 and comprises a number of drill pipe joints 7, lengthwise sufficient, to form a slender-column that is elastically unstable. One may push (placed under compression) one drill pipe joint without the drill pipe joint deforming; a behavior consistent with that of a short-column where the material strength is in control. However, as the length of the drill string increases, the end-conditions, its modulus of elasticity and slenderness become the controlling factors, not its strength. Elastic instability will result in the deformation of a 10,000' drill string when it is pushed upwards by the formation hydrocarbons 9 as illustrated in FIGS. 7 & 8; a behavior consistent with that of a long-column.

The direction of the loads the drill string endures and its behavior under loading define its interaction with BOP 4 and therefore the BOP missions. Another objective of the present invention is to teach how to automatically detect and recognize the drill pipe 7 behavior inside BOP 4 annulus 8, said behavior also been an indication of a well kick, and to formulate a plan to bring the well under control early enough while control is still possible.

An additional benefit of the present invention is that the detection and recognition of drill pipe 7 behaviors inside annulus 8 during operations may prevent damage to drill pipe, BOP 4, the rubber goods and similar items during drilling.

Each drill pipe, such as drill pipe 7 may include RFID chip 38 as indicated in FIG. 3 that identifies each pipe and preferably provides a history of each pipe in the drill string. Subsea Computer 20 is programmed to keep track of each pipe and the material features of the pipe discussed herein. However a surface computer could also be utilized either alternately or concurrently or in coordination with the subsea computer. The surface or subsea computer is programmed to use previous inspection data to determine an amount of force to cut a particular pipe in the string of pipe based on information stored in an rfid for the particular pipe. Accordingly, RFIDs are mounted or secured in or on the pipes. The RFIDs can then be scanned by sensors such as S1, S2, or the like to produce data such as inspection data or other information that is stored in memory or the RFID tag. In other words, sensors for the RFID may be mounted around the BOP.

The information from the RFID and other detected information is preferably stored in a database containing pipe material features. The subsea BOP computer or surface computer can do a pipe tally each trip of the pipe string. FIG. 3 schematically shows various internal components of BOPs including pistons, piston rods as indicated at 46 and 48. There are many variations of these piston, piston rods, shear elements for rams that are well known. However, the present invention provides sensors to monitor these elements to allow a status and a health report. Likewise, internal shear elements 42 and 44 of the shear rams are schematically illustrated which may be of many different well known types. Sensor arrays 50, 52, 54, and 56 may be mounted internally or externally to monitor the speed and position of the piston rods, pistons, and shear rams. These may be referred to as shear ram sensors, position sensors, and the like. These may comprise linear arrangements of sensors and/or encircle the appropriate portions of the rams. The computer can use this information to control operation of the cut. The computer can also use this information to produce a status or health of the shear ram. The computer can measure whether a cut was initiated, completed, is waiting to be cut, hammer operating is initiated and progress there of.

The computer 20 can keep track of the downhole assembly including heavy weight pipe, motors, drill bits, wireline, tubulars, casing, well monitoring equipment, production tools or other components some of which are indicated at 36 in FIG. 3. If these items pass through the BOP, then this will be detected and action can be taken. For example the wellbore could be closed off and additional warnings could be made. Communication link 22 may also connect to a surface warning system that includes warning devices 34 such as wearable smart devices, tactile alarms, visual alarms, audible alarms, smart devices, tablets, phone systems, watches, wearables, smart glasses or the like. These provide a status monitor of operation of the subsea BOP, shear rams, and the like. Communication link 22 may also connect to onshore monitors 32 as shown in FIG. 3 that can monitor the status of the BOP and connect to the computeror surface computer. Accordingly, a status monitor detects parameters that are utilized to determine a status or health of the BOP.

Prior art BOPs are designed to function in a static, designer-specified environment, not in a real-world environment; the root-cause of the BOP failures. When the designer defines the BOP environment, the designer defines an event-space static convenient condition. For example, the BOPs today are designed to shear drill pipe nominal body-wall that is static, under tension and near the center of the shear rams without any feedback if any of the assumptions are valid (see FIG. 6); a string of convenient static assumptions to deal with a forceful dynamic event. Well-operations are performed under the following controlled (as opposed to a blowout) conditions:

the rig crew is in control;

the rig is functioning;

the rig provides the drill pipe controlling force;

the drill string is under tension;

the drill pipe is near the center of the BOP;

the rig crew may position a drill pipe body-wall inside the shear rams;

the drill string is static (the rig crew can take a long time to perform the task);

the well flow is under the control of the rig crew;

the BOP sequencing, like the EDS sequence, may be programmed and carried-out after the rig crew has optimized the "space-time" for the "event" to succeed;

nominal shearing force is required to complete the task in the optimized environment; and there is no life-threatening urgency to complete the task.

The Deepwater Horizon BOP functioned as-designed and successfully completed an EDS in June of 2003 under the above controlled conditions proving that the Deepwater Horizon BOP was maintained properly all along. This, however, is assumed erroneously to be adequate proof that BOP 4 could also arrest and control a well blowout.

Transition from Operation to Blowout

The transition from operation to blowout is not sudden (for a computer) and may be divided, at least, into two stages: Alert and Alarm. For example, an Alert stage may be triggered by one or more of computer 20 monitored parameters exceeding an Alert threshold, such as, changes in pump speed, excess annulus flow resulting in increased pit volume, lateral motion of the drill pipe (illustrated in FIGS. 5A and 5B), vibration of the drill pipe, insufficient volume of replacement fluid when tripping-out the drill pipe, sudden increase in drilling rate, similar items and combinations thereof. The first Alert action is to notify the rig crew, through communication link 22, and verify that the rig crew is still in control, the rig is still functional and there is no power loss. A surface computer may display the prescribed steps to deal with the Alert. It should be noted that there is a degree of urgency to identify the source of the Alert and act upon.

Figure 5A:
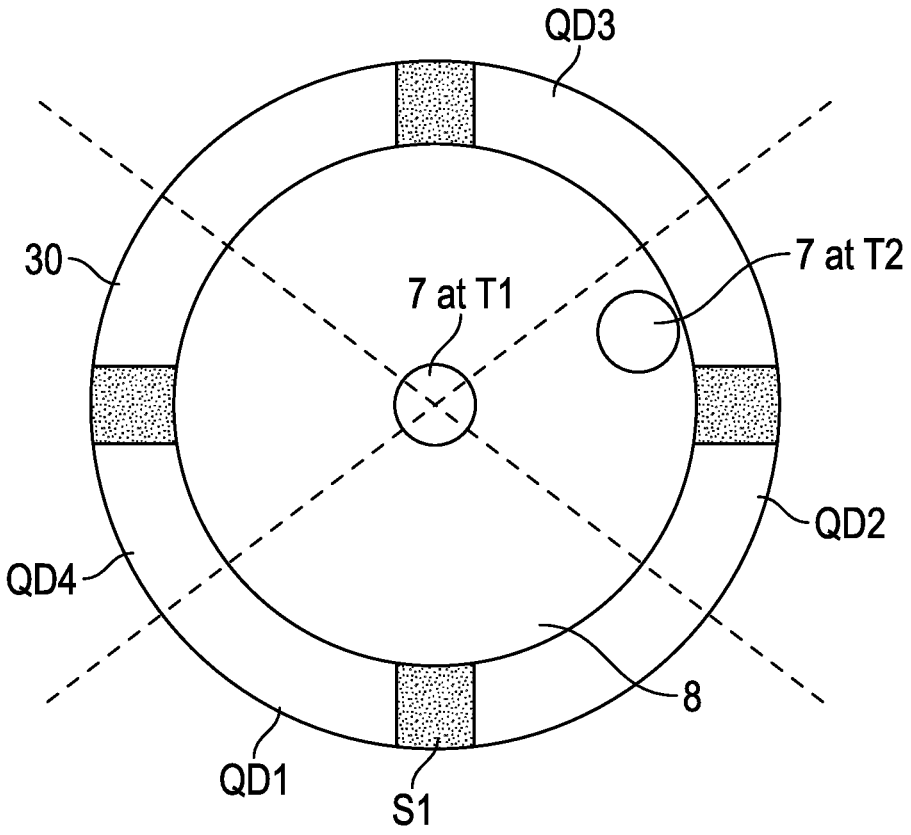
FIG. 5A illustrates a top view of a BOP non-contact sensor in accord with one possible embodiment of the present invention.
Figure 5B:
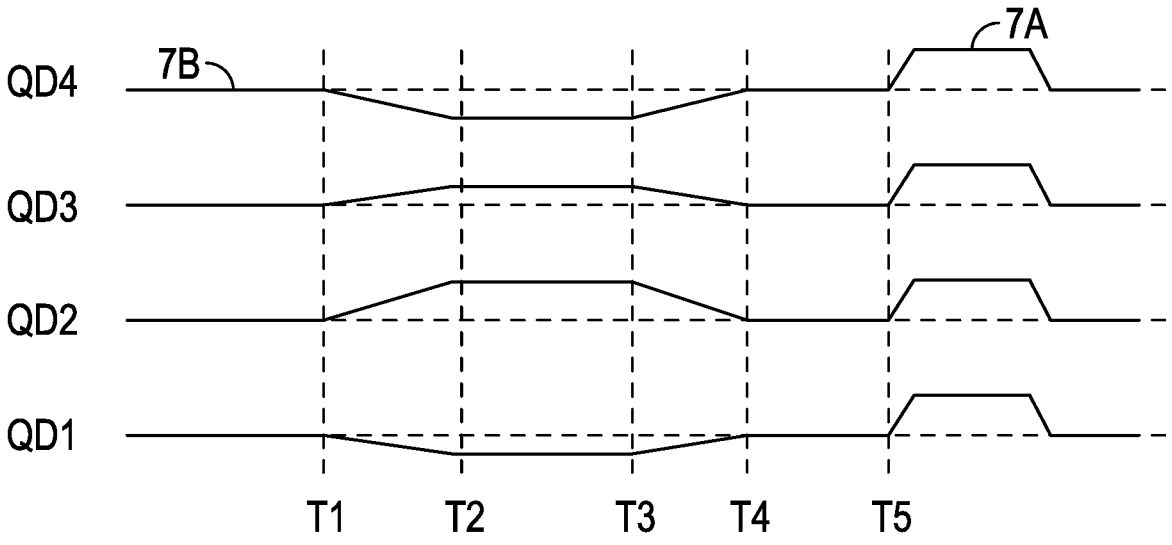
FIG. 5B illustrates sensor signals processed in quadrants (QD1 through QD4) in accord with one possible embodiment of the present invention.

FIG. 5A is a top view of one embodiment of sensor 30 and illustrates the position of drill pipe 7 at times T1 and T2. FIG. 5B illustrates the signals from sensor 30 processed by computer 20 in quadrants QD1 through QD4. It should be understood that the signals of sensors S1 through SN, as shown and discussed in reference to FIG. 4, may be processed individually, in segments, as a single trace, or any combination thereof.

Figure 6A:
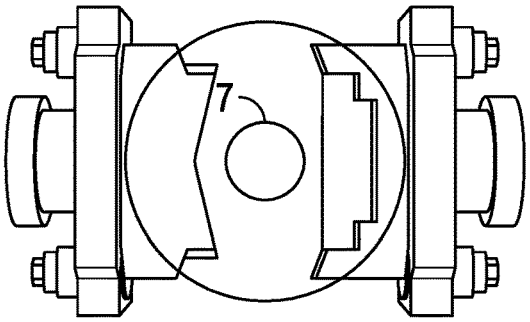
FIG. 6A (Prior Art)
FIG. 6A illustrates a top view of a BOP with the drill pipe near the center in accord with Deepwater Horizon BOP design criteria wherein the design criteria is different than what occurred with buckled pipe.

FIG. 5B illustrates that up to time T1 drill pipe body-wall 7B is in the center of BOP 4 resulting in equal quadrant signals (also see FIG. 6A—an optimal position for shearing). After time T1, drill pipe 7 starts moving toward QD2 and QD3, resulting in higher signals and away from QD1 and QD4 resulting in lower signals. At time T2, drill pipe 7 is resting on BOP 4 ID wall, a condition that may lead to keyseat 40 as illustrated in FIG. 4 (also see FIG. 6D—the worst position for shearing). The QD1 through QD4 signals allows computer 20 to calculate the three-dimensional position of drill pipe 7 along the length of BOP 4. The degree to which drill pipe 7 is off-center inside BOP 4 would then be a measure of the ability of shear rams 4B to shear drill pipe 7 and the corrective action required to seal-off the well, such as a ram pressure increase through a pressure intensifier (FIG. 4 12C and FIG. 10 12B).

At time T3, drill pipe 7 starts moving again toward another location and returns to the center of BOP 4 at time T4. This lateral motion of drill pipe 7 may trigger an Alert if it is not corresponding to an activity on rig 1. At time T5 tool-joint 7A goes through the center of sensor 30 resulting in a signal increase in all four quadrants. The signals may be combined to a single trace for display to the rig crew as shown in FIGS. 9A through 9F. It should be understood that the processing of the sensor signals in quadrants or a single trace does not limit the scope of the present invention. Smaller arcs such as but not limited to eighths, sixteenths, and the like may be utilized as well as additional numbers of sensors around the circumference.

An Alarm stage may be triggered by one or more of monitored parameters exceeding an Alarm threshold while the rig crew is still in control and the rig is still functional (which can be verified through feedback). A surface computer may display the prescribed steps to deal with the Alarm. It should be noted that there may be a life-threatening urgency to identify the source of the Alarm and act upon it rapidly as it may evolve into a blowout before the rig crew has time to react. For example, if the rig is not tripping out the drill pipe and the drill string starts traveling upwards as illustrated in FIG. 9F, computer 20 should start formulating a Blowout-Arrestor sequence and request and monitor a timely response from the rig crew (feedback) before activating the Blowout-Arrestor sequence. Computer 20 may calculate the speed of the blowout evolution from the monitored parameters and thus a rig crew timely response interval which can be displayed on a surface computer countdown including audible and visual alarms, tactile alarms, and/or use of smart devices programmed to provide an alarm.

The BOP as a Blowout-Arrestor

Referring back to FIG. 2, well hydrocarbons 9 push the elastically unstable drill string 7 upwards. The well walls limit the drill string deformation by controlling its lateral displacement and slope, illustrated in FIGS. 7 & 8, and therefore, one would expect drill pipe 7 to rest against the well, BOP 4 and Riser 6 walls regardless of the ID/OD differential pressure.

Figure 6B:
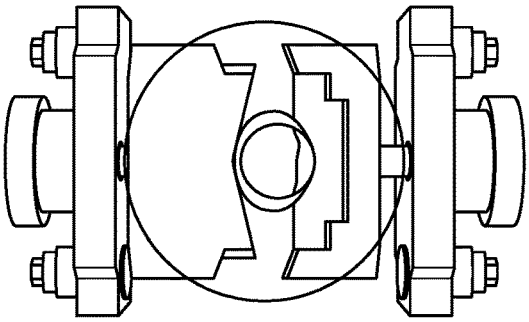
FIG. 6B (Prior Art)
FIG. 6B illustrates the blind shear rams mid-way to closing on the drill pipe body wall near the center in accord with Deepwater Horizon BOP design criteria.
Figure 6C:
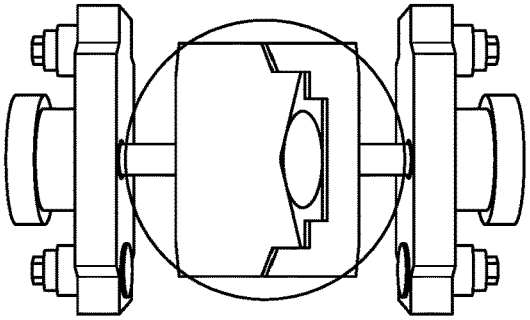
FIG. 6C (Prior Art)
FIG. 6C illustrates the closed blind shear rams near the center near the center in accord with Deepwater Horizon BOP design criteria.
Figure 6D:
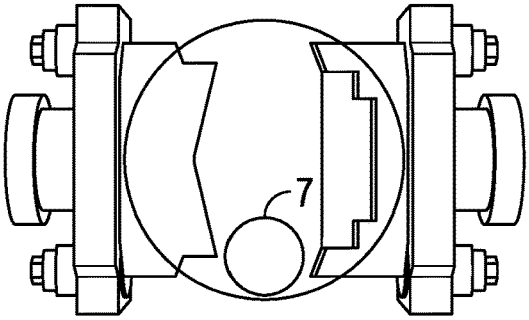
FIG. 6D (Prior Art)
FIG. 6D illustrates a top view of a BOP with the drill pipe off-center due to a buckled drill pipe configuration as occurred in the blowout as per the investigation report volume 2, Jun. 5, 2014 leaving the well unsealed.
Figure 6E:
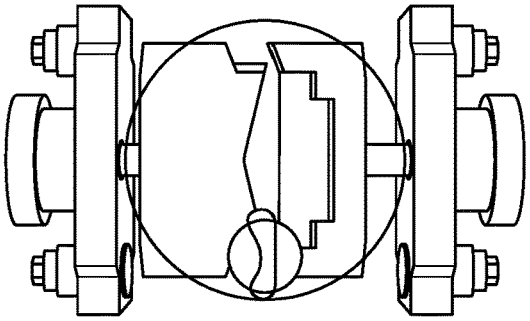
FIG. 6E (Prior Art)
FIG. 6E illustrates the blind shear rams closing on the off centered drill pipe body wall with the drill pipe off-center due to a buckled drill pipe configuration as occurred in the blowout as per the investigation report volume 2, Jun. 5, 2014 leaving the well unsealed.
Figure 6F:
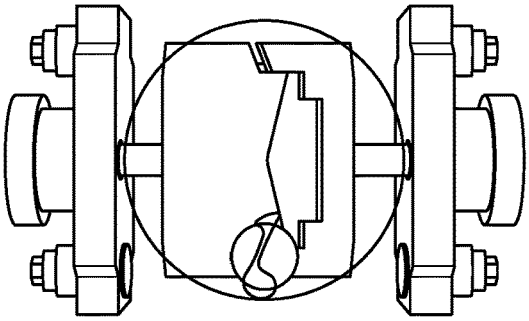
FIG. 6F (Prior Art)
FIG. 6F illustrates the off centered drill pipe obstructing the blind shear rams with the drill pipe found off-center due to a buckled drill pipe configuration as occurred in the blowout as per the Macondo Investigation Report Volume 2, Jun. 5, 2014 causing the blind shear rams to close only partially and leaving the well unsealed.

The controlled conditions of the well-operations are no longer valid during a blowout. Instead, they are replaced by the random and erratic conditions imposed by an unpredictable forceful dynamic event, the well blowout. It should be noted that the well blowout parameters may change rapidly and an accurate rapid response is crucial to control the situation. Drill pipe 7 behaviors inside BOP 4 may progress from FIG. 7 to FIG. 8 to FIG. 2 in a very short time frame. Depending on the pressure and volume, the rig crew may not become aware of the blowout in time to address the problems. FIGS. 6A through 6C show that the shear rams are designed to shear drill pipe 7 near the center of BOP 4 under the static Operation-Aid assumptions. FIGS. 6D through 6F show that the prior art shear rams were not designed to shear drill pipe 7 illustrated in FIGS. 3, 7 and 8 and in fact, they did not. It is reasonable to conclude that this design oversight is one of the root-cause of the Macondo and other similar disasters.

It should also be noted that not all well blowouts behave identically. The unpredictability of a well blowout makes it impossible to program a fixed automatic sequence of BOP 4 to arrest and restrain the blowout. In fact, a fixed automatic sequencing, like the EDS sequence, may worsen the problem. However, prior art BOP's still rely on the fixed EDS sequence to arrest and restrain a blowout (see Macondo reports)—another root-cause of the Macondo and other disaster.

Generally, one or more of the following situation is true during a blowout:

the rig crew may not be in control and may be incapacitated which the AutoBOP can ascertain;

the rig may no longer be functional which the AutoBOP can ascertain;

the upward flow of hydrocarbons provides the drill pipe controlling force, not the rig, which the AutoBOP can ascertain;

the drill string may be deformed and under compression which the AutoBOP monitors;

the drill pipe may be resting on the BOP wall that limits the degree of its deformation which the AutoBOP monitors;

it is unknown what is inside the BOP shear rams and it varies with time. The AutoBOP knows continuously what-is, how-is and where-is including its critical parameters;

the drill string is traveling as it is ejected by the blowout fluids and gases which the AutoBOP monitors and calculates a velocity and acceleration;

the well is flowing under the control of the formation which the AutoBOP monitors;

the Blowout-Arrestor sequence can only be formulated by monitoring the blowout evolution;

shearing force above nominal is required to complete the task; and there is a life-threatening urgency to seal the well in the shortest possible time.

Although the Deepwater Horizon BOP was maintained properly all along, it failed to control the Macondo well blowout in April 2010 because it was designed as an Operations-Aid not a Blowout-Arrestor and therefore, it was not fit-for-purpose and not seaworthy.

Shearing-Force

BOP manufacturers use distortion energy theory to estimate a shearing-force. Some use the yield strength of the drill pipe and others use the ultimate strength in their calculations; the later providing higher shearing-force estimates. However, neither provides a high enough estimate to cover the worst case scenario as detailed below—yet another root-cause of the Macondo and other disasters.

For the following analysis it is assumed that an Operations-Aid requires a nominal shearing-force (100%) to shear a high-ductility drill pipe body-wall 7B (See FIG. 4) in the shear rams when the drill pipe 7 is near the center of BOP 4 and it is under tension. Tension aids the shearing by acting on the stress-concentrator the shear rams created to tear the drill pipe 7 apart. In addition, new OCTG wall thickness may vary up to +8%. Therefore, the nominal shearing-force must handle, at minimum, drill pipe with wall thickness of 108% of the specified value. If the nominal shearing-force calculations were based on low-ductility drill pipe, then the following estimates should be increased by up to 180% for high-ductility drill pipe. The required shearing-force may:

increase if there is other material, such as a cable, inside the drill pipe which the AutoBOP will detect;

increase to 130% with higher drill pipe internal pressure which the Auto BOP monitors;

increase due to the BOP temperature gradient (seawater—well fluids) which the AutoBOP monitors;

increase to 120% if the drill pipe body-wall is off-center, but still in the shearing surface which the AutoBOP monitors;

increase to 140% if the drill pipe body-wall is under compression which the AutoBOP can estimate (the absence of the beneficial tension);

increase to 150% if the drill pipe body-wall is buckled which the AutoBOP monitors;

increase to 130% if the well is flowing which the AutoBOP monitors;

increase if there is pressure trapped below the closed annular which the AutoBOP monitors.

It should be understood that the above estimates are cumulative and, again, apply only when the nominal body-wall 7B of the drill pipe 7 is in the shear rams. Therefore, under the conditions detailed above, the Blowout-Arrestor may require 400% the nominal shearing-force of an Operations-Aid for the same drill pipe. It should also be understood that the early intervention of the present invention would reduce the maximum shearing force required. Furthermore, per API S53 (7.6.11.7.5), the maximum shearing pressure should be less than 90% of the maximum operating pressure of the shear ram actuator 5. Therefore, the present invention would incorporate shear rams and actuators 5 to match the cumulative maximum calculated shearing force, not just an estimated nominal. Existing BOPs will be modified accordingly.

Faulty BOP Activation Makes the Blowout Worse

There are multiple videos and pictures where a well blowout is ejecting the drill string at high speed above the derrick before gravity bends it into a loop as illustrated in FIG. 2. It would then be reasonable to conclude that a drill pipe tool-joint 7A would most likely be the first one to collide with a restriction, such as an activated BOP 4 ram. The collision may damage the rubber goods and a tool-joint 7A may jam inside the restriction. The drill pipe body-wall 7B below would then be further deformed by the collision impact and it may bend, buckle, twist and break so that more than one drill pipe pieces may end up stuck inside BOP 4 as the Macondo investigation has extensively documented.

The time interval from the beginning of the kick until the rig crew recognizes the kick and activates BOP 4 defines the severity of the collision and its repercussion. It is therefore desirable to recognize a kick early on and to react rapidly. The drill pipe upward motion without corresponding rig activity, a sudden off centering (illustrated in FIGS. 4, 5, 7 & 8), a helical deformation (corkscrew—illustrated in FIG. 8), a vibration or a change in the vibration frequencies, other axial, lateral and angular motions and any combination thereof may be an early warning of a kick along with increased flow and pit volume. In one embodiment, the warning system may comprise use of a natural speech or language machine to explain the problem. Prior art EDS sequencing of BOP 4 worsens the blowout problem by typically activating the annular preventer 4C and thus trapping the collision results inside BOP 4. It would be much better to activate the lower BOP first.

Detailed Description of the AutoBOP Predictive-Controller

FIG. 3 illustrates a simplified subsea BOP 4 with a number of non-contact sensors 30 that may be placed along the length of BOP 4 stack, illustrated as 30A through 30D, to monitor the OCTG and other material inside BOP 4 annulus 8. It should be understood that the present invention does not require all sensors 30 illustrated in FIG. 3. For example, rams 4A and 4B may be combined in a single casting eliminating sensor 30B. It should also be understood that sensor 30 may comprise at least a primary and a secondary sensor array for reliability along with the corresponding signal processing and communication means. While the present invention is not directed to any particular sensor such as noncontact sensors mounted externally to the BOP, one possible embodiment may utilize magnetic sensors and may also utilize magnetization of pipe devices at the surface to increase the sensitivity of the magnetic sensors. The invention is not limited to these magnetic sensors and preferably may include sensors mounted externally or other types of non-contact sensors.

As discussed previously herein, Sensor interface 27 processes Sensor 30 analog signals and converts said analog signals to a digital format under the control of computer 20. Computer 20 further provides controlled excitation 26. Assuming that sensor 30 comprises of N individual sensors, computer 20 may process said digital signals into N traces around BOP 4 circumference or may combine the signals into eight or four traces as illustrated in FIGS. 5A & 5B or may combine the signals into a single trace as illustrated in FIGS. 9A through 9F, all of the above or any other combination thereof. Additional traces might also be produced. It should be understood that computer 20 will also process the sensor signals in BOP 4 axial direction by utilizing Na through Nd digital signals from sensors 30A through 30D in any combination. It should also be understood that computer predictive-software 28 may utilize more than one signal processing path, said signal processing may change with the evolution of the blowout.

Referring to FIG. 7, the sensor signals from sensor 30D would resemble the signals of FIG. 5B as the drill pipe 7 is illustrated closer to quadrants 2 and 3. Sensor 30A signals would be the opposite as the drill pipe 7 is illustrated closer to quadrants 1 and 4. Sensors 30B and 30C signals intermediate values would indicate that the drill pipe 7 is straight and at an angle.

Referring to FIG. 8, signals produced by sensors 30A, 30B, 30C, and 30D would indicate that drill pipe 7 is helically deformed as it is closer to different quadrants along the length of the annulus. It should be noted that if drill pipe 7 lays sideways inside the bore of BOP 4, sensor 30 will also detect the resulting increase in wall thickness and diameter, the effective wall thickness and diameter the shear rams will encounter.

It should be understood that calculations may be performed using different sensor combinations along sensor 30 plane (x-y) and among different sensors (z). Furthermore, it should be understood that each sensor 30 may comprise similar or different types of individual sensors that may be mounted on an x-y plane perpendicular to BOP 4 vertical axis or be stacked in the z axis or any combination thereof. Different types of sensors may require different excitation 26 and therefore, each sensor 30 may further comprise one or more excitation inducers or the excitation inducers may be mounted separately or any combination thereof.

Computer 20 may transmit the results to the surface and receive data and commands from the surface or a remote operator through communication link 22. Power and communication subsea connector 23 allows an ROV to restore BOP power, both electrical and hydraulic and operate computer 20 and the peripherals through peripheral-bus 21.

Computer 20 also processes and assimilates information from a number of Data Acquisition sensors 25 through the data acquisition system 24. Data Acquisition Sensors 25 are disposed around Rig 1 and BOP 4 and may measure capacitance, contactivity, current, deflection, density, external pressure, fluid volume, flow rate, frequency, impedance, inductance, internal pressure, length, rate, accumulator pressure, pressure, resistance, sound, temperature, vibration, voltage, similar items and combinations thereof.

BOP Monitoring

Figure 9A:
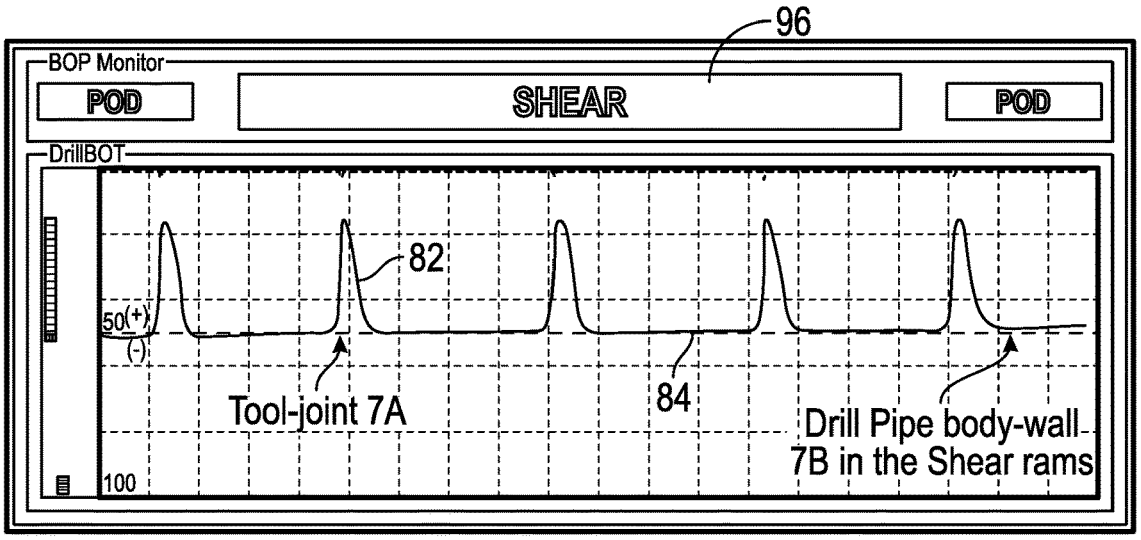
FIG. 9A illustrates nominal body-wall drill pipe traveling through the BOP shear rams in accord with one possible embodiment of the present invention.

FIG. 9A illustrates an example of a sensor trace processed by computer 20 and transmitted to a surface computer on Rig 1 through communication port 22 by AutoBOP 40. The trace is showing drill pipe 7 being tripped out of the well during a well operation under the control of the rig crew. The trace shows a drill pipe tool-joint 7A at 82 and drill pipe body-wall 7B thickness 84. Shear rams 4B are not designed to shear through tool-joint 7A as discussed in FIGS. 4 and 9D, so computer 20 indicates to the rig crew in real time whether shear is possible or not. With drill pipe body-wall 7B in shear rams, shear is possible and is indicated so in a green background at 96. It should also be understood that computer 20 takes into account all other monitored parameters through data acquisition system 24 and Data Acquisition sensors 25 prior to making the determination that shear is possible.

Figure 9B:
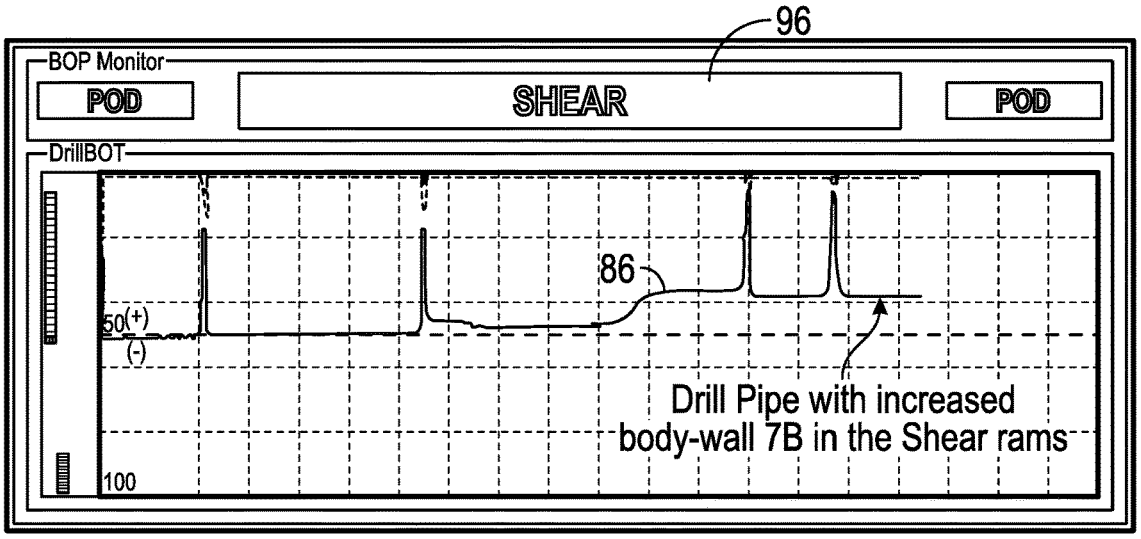
FIG. 9B illustrates drill pipe with increased body-wall through the BOP shear rams in accord with one possible embodiment of the present invention.

FIG. 9B illustrates a sensor trace detecting drill pipe 7 with increased body-wall thickness 7*b*, still within the capabilities of the shear rams 4B at 86, meaning shear is possible and is indicated at 96.

Figure 9C:
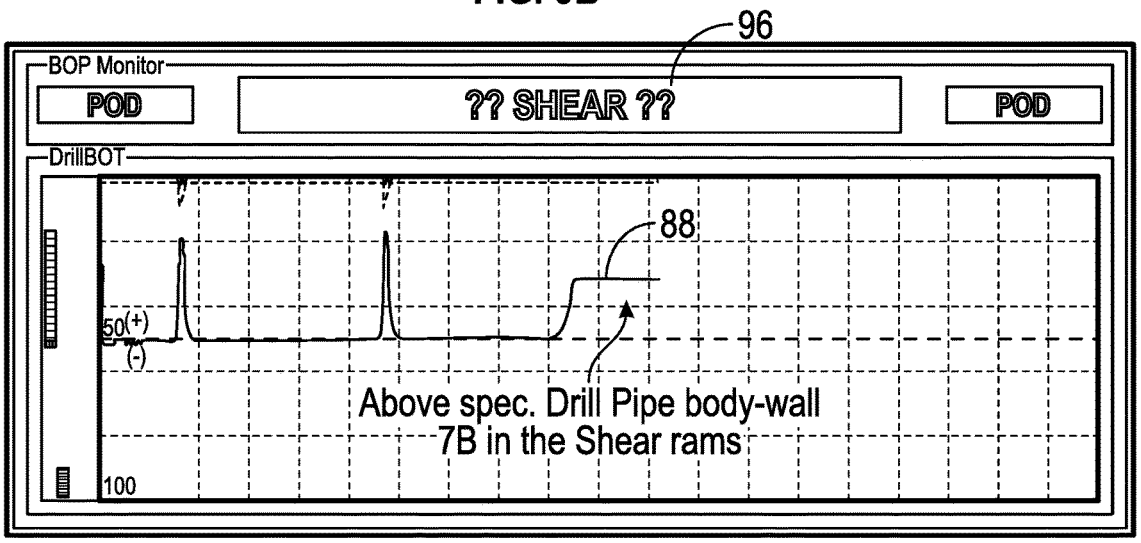
FIG. 9C illustrates drill pipe with increased body-wall to trigger an Alert in accord with one possible embodiment of the present invention.

FIG. 9C illustrates a sensor trace detecting drill pipe 7 with wall thickness at the maximum limit of shear rams 4B at 88. If shear is required and since drill pipe 7 is still under the control of the rig crew, the rig crew may position the drill pipe body-wall 7B across the shear rams 4*b* by raising or lowering the drill pipe 7 to perhaps find a lower body wall thickness and to stretch the pipe. Computer 20 displays that shear may be possible at 96.

Figure 9D:
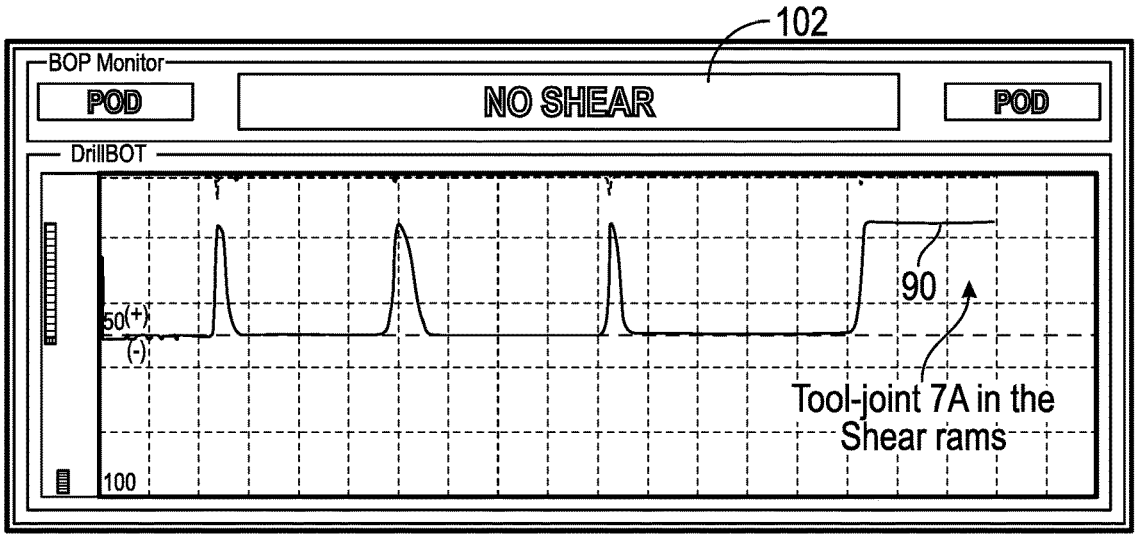
FIG. 9D illustrates drill pipe tool-joint through the BOP shear rams in accord with one possible embodiment of the present invention.

FIG. 9D illustrates a tool-joint across shear rams 4*b* at 90 as illustrated in FIG. 4. Tool joint 7A cannot be sheared as indicated at 102.

Figure 9E:
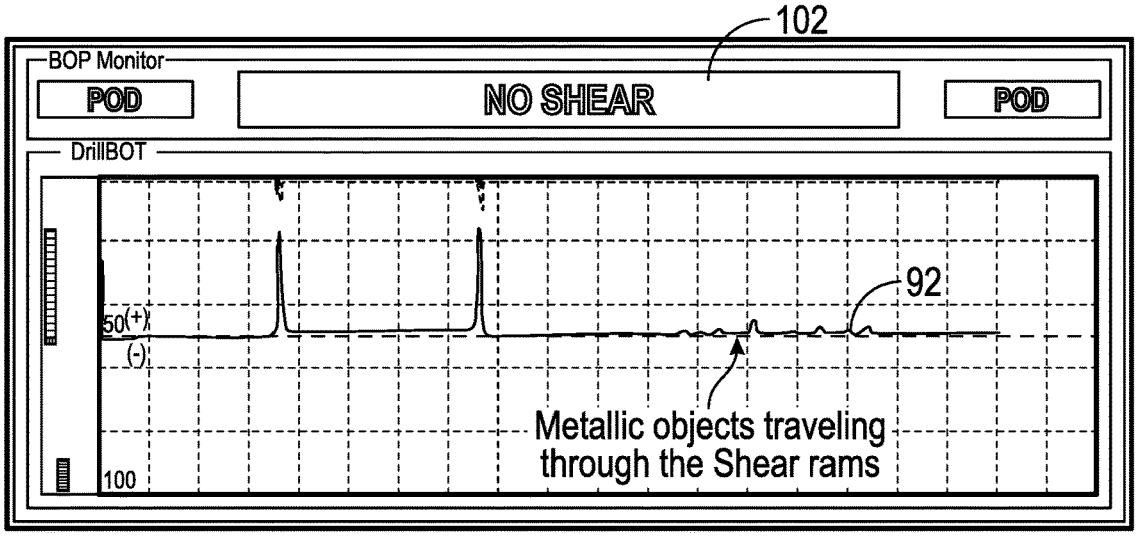
FIG. 9E illustrates metallic objects traveling through the BOP shear rams in accord with one possible embodiment of the present invention.
Figure 9F:
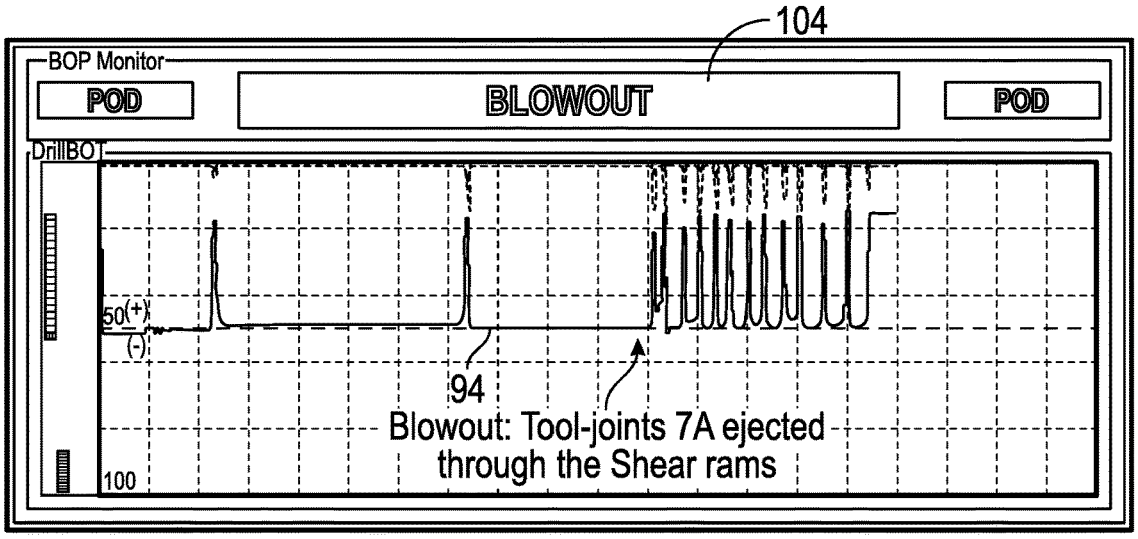
FIG. 9F illustrates drill pipe ejected through the BOP shear rams in accord with one possible embodiment of the present invention.

FIG. 9E illustrates metallic objects traveling through sensor 30 at 92. The direction of travel can be established by examining the signals of sensors 30A through 30D. If the metallic objects traveled through sensor 30D first and then through sensor 30C, they are falling into the well; an event the rig crew should be aware off. Metallic objects traveling upwards may be an indication of a serious downhole anomaly that should trigger, at minimum, an Alert and notifies user that the pipe cannot be sheared as indicated at 102. In one embodiment, the warning may comprise use of a natural speech machine to explain the problem.

FIG. 9F illustrates a number of tool-joints 7A travelling at high speed through sensor 30 at 94. Again, if tool-joints 7A traveled through sensor 30D first and then through sensor 30C, a reasonable conclusion would be that the drill string broke and it is falling into the well, a condition that may result in loss of well control. However, if computer 20 determined that tool-joints 7A are being ejected out of the well as illustrated in FIG. 2, then computer 20 should enter into the blowout-arrestor mode as shown at 104.

It should be understood that although FIGS. 9A through 9F illustrate the body-wall 7B and tool-joints 7A, computer 20 also performs additional calculations that include, but are not limited to, drill-pipe hardness, geometry and three-dimensional location along the length of BOP 4, including any additional material, along with all other monitored parameters through data acquisition system 24 and Data Acquisition sensors 25. It should also be understood that the surface computer may also display the quadrant traces illustrated in FIG. 5B or any other combination thereof including, but not limited, to parameters monitored by data acquisition system 24 through Data Acquisition sensors 25.

BOP Control

Again, BOP 4 is a complex machine that can be operated in multiple ways to achieve a goal while enduring a compendium of (variable) forces and interactions that, most likely, are redefining the goal. However, most often complexity is of low utility. For example, a human does not study all the details of a train before recognizing that it is a train or that the train is moving or not. Instead, humans reduce the myriad of complex train patterns to a simple unique pattern that is a property of trains, as opposed to trucks or airplanes.

AutoBOP 4 uses the same approach to define the predictive-software whereby, the complex BOP 4 operational states are reduced to a sequence(s) of simple patterns that may be interconnected through an equation or a system of equations (numerical, logic, fuzzy), tables (numerical, logic or fuzzy), other relational operators, similar items and combinations thereof, thus preserving and accounting for the dynamic properties and interactions. It should be noted that AutoBOP 4 operates in a limited space, within limited time (when needed) and has limited resources to solve the Problem.

Figure 10A:
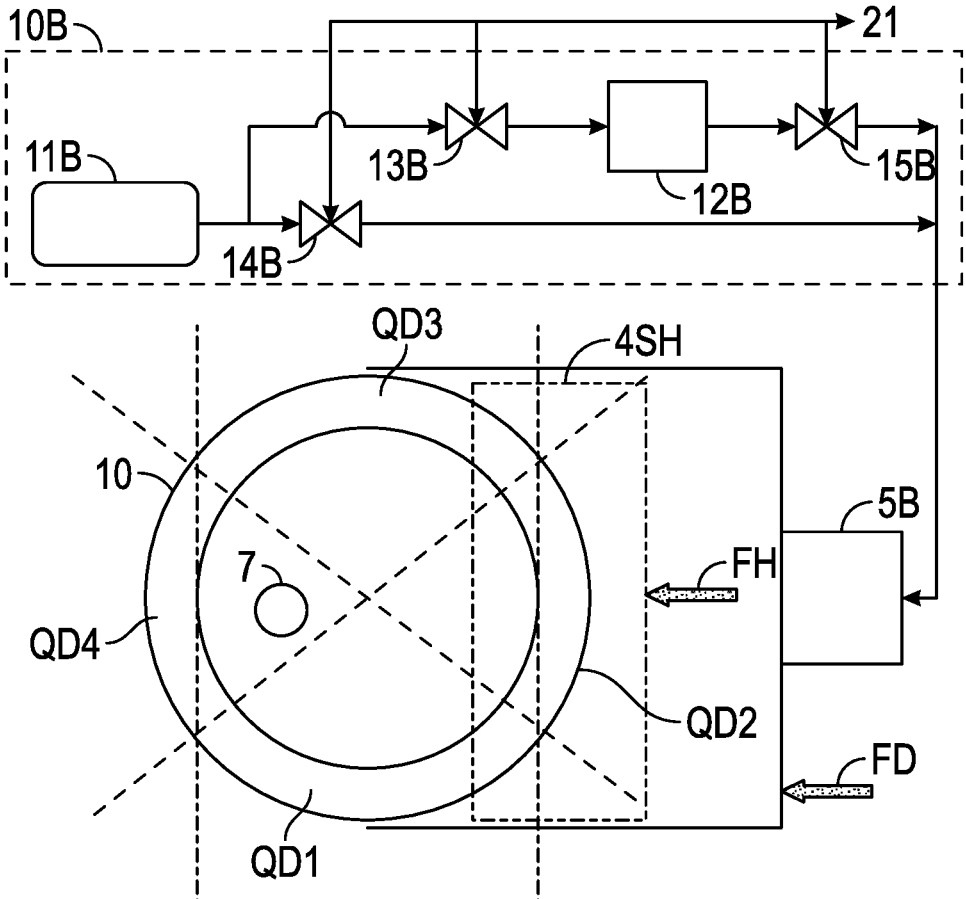
FIG. 10A illustrates a partial top view of the BOP shear rams in accord with one possible embodiment of the present invention.
Figure 10B:
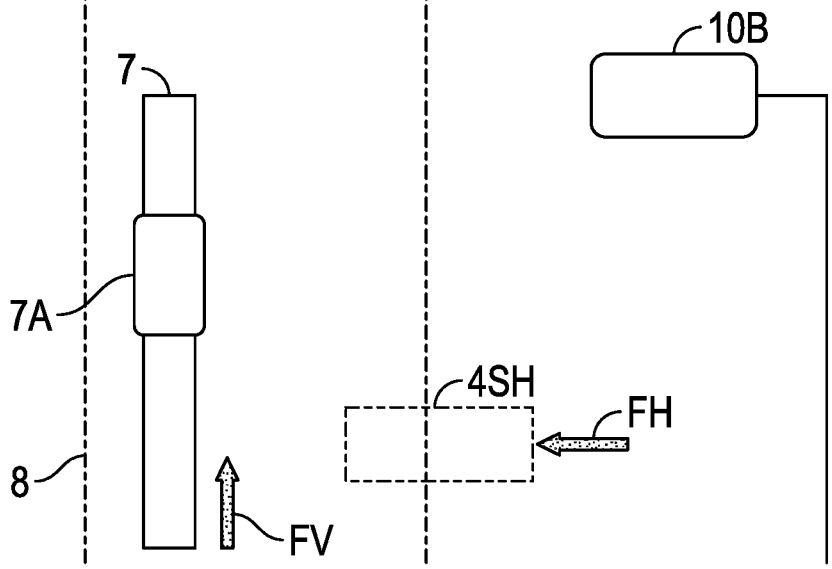
FIG. 10B illustrates a partial side view of the BOP shear rams in accord with one possible embodiment of the present invention.

FIG. 10A illustrates a simplified one-side top-view of BOP 4 shear ram 4SH and FIG. 10B illustrates a simplified one-side side-view of BOP 4 shear ram 4SH.

For example, during normal operations, computer 20 may scan each drill pipe joint 7 and store in database critical information in a drill string lengthwise format comprising of wall thickness, imperfections, hardness, dimensions, wear, stress concentration, weight, similar items and combination thereof. Computer 20 may then use the stored critical information to calculate a required nominal shearing force FH along the length of the drill string and may notify the rig crew when it detects drill pipe 7 that exceeds the shearing specifications. It should be understood that computer 20 updates the lengthwise drill string critical information in subsequent scans so that the database comprises of the latest data.

Computer predictive-software 28 therefore knows in some detail the nominal shearing force required for each drill pipe joint 7 and may translate it to a horizontal force FH acting on shear ram 4SH through piston 5B and thus, the minimum pressure to drive piston 5B. Computer 20 also knows each drill pipe joint 7 below the shear rams and the location of each drill pipe joint 7 in the string; knows the flow rate through communication link 22 and may calculate a Force FV; knows the temperature through the data acquisition system 24 and Data Acquisition sensor 25; knows the drill pipe 7 internal pressure from a surface pressure monitor through communication link 22 and knows the location and angle of the drill pipe 7 through sensors 30 and thus computer 20 may rapidly calculate a corrected shearing force and a minimum pressure to drive piston 5B.

FIG. 10A illustrates that shear ram 4SH is operated by piston 5B which may be driven directly from accumulator 11B or through a pressure intensifier 12B. Again, it should be understood that accumulator system 10B may comprise more than one accumulator 11B, pressure intensifier 12B, computer 20 controlled valves 13B, 14B, 15B and similar components. However, this is a limited resource requiring that computer 20 maximizes its effectiveness. Furthermore, computer 20 measures the accumulator 11B pressure and temperature through data acquisition system 24 and Data Acquisition sensors 25 and the pressure drop when ram 4SH is activated. Further in one embodiment, the computer measures the process of the shear of the pipe, the speed, the acceleration, whether the shear is complete, whether the acceleration and speed is decreasing to the extent to predict the cut will not be made and so forth.

When a blowout is detected, predictive software 28 of computer 20 may rapidly decide how to drive piston 5B. When the drill pipe joint 7 enters the shear rams SH, computer 20 only needs to detect a significant deviation from the stored drill pipe joint 7 parameters, its location and any deformation to correct the required shearing force. Since the AutoBOP acts early on, it is not expected that any drill pipe joint 7 will be significantly deformed and thus requiring a lower shearing force. Computer 20 would then select how to drive piston 5B.

For each selection, there is an associated equation or table or graph that defines the pressure (time) function that drives piston 5B. Drill pipe 7 known dimensions may be translated to piston 5B length travel and therefore, the horizontal Force FH acting upon the drill pipe 7 wall. If computer 20 determines that the accumulator 11B pressure is not adequate to shear the drill pipe 7, computer 20 may switch the shear rams 4SH piston 5B to pressure intensifier 12B. Computer 20 will close valve 14B and open valves 13B and 15B. Computer 20 may do so in advance in anticipation of the next drill pipe joint 7.

The time interval between tool joints 7A of FIG. 9F allows for the calculation of the speed of drill pipe 7 and a calculation of when the blowout will reach the surface as the water depth of BOP 4 is known. FIG. 9F also illustrates the difficulty of a human operator to react timely and correctly. Computer 20 database comprises, at minimum per API S53, of the "Actuation times shall be recorded in a database . . . " and may measure accumulators 11 pressure and temperature through data acquisition system 24 and data acquisition sensors 25. Therefore, computer 20 may calculate an optimal ram activation time and sequence to maximize the probability of controlling the well. It should be noted that the location of drill pipe 7 would also be an indication of the location of the closed rams from BOP 4.

Again, an EDS/Deadman sequence will activate annular preventer 4C first resulting in a collision with a tool-joint 7A and trapping the results of the collision inside BOP 4 below annular preventer 4C. Instead, for example, properly timed rapid sequencing of pipe ram 4A followed by annular preventer 4C and then by shear ram 4B would place drill pipe wall 7B inside shear rams 4B and the results of tool-joint 7A collision with pipe ram 4A below BOP 4. In addition, the momentum of the traveling drill string above pipe ram 4A may temporarily place the drill pipe inside shear ram 4B under tension. It should also be understood that AutoBOP 40 reaction would take place at the initial stages of a blowout where forces and momentum is still low enough to control. It should be noted that an estimation of the drill string momentum may be easily calculated from the string weight by adding the weight of each drill pipe joint 7 and the speed of the drill string.

When Things Still go Wrong

The above calculations however ignore the absence of the beneficial tension that makes certain BOP actions ineffective [see API S53 (7.6.11.7.11)]. The Blowout-Arrestor of the present invention increases the shearing-force and adds a tearing-force to drill pipe 7. During a blowout, shear ram 4B may be driven by pressure intensifier(s) 12B and pipe ram 4A may be driven to a lateral oscillation to aid the tearing of the drill pipe inside shear ram 4B through cumulative fatigue. Even a small-magnitude oscillation would focus on the stress-concentrator that was created by shear ram 4B. Pipe ram 4A surface may utilize a pipe gripper to prevent slippage and may incorporate an actuator with extended reach. The lateral oscillation will also require higher actuator pressure and volume. It should be understood that the lateral oscillation of pipe ram 4A may undermine the shearing force of shear ram 4B and therefore, the AutoBOP would apply corrective pressure or a locking mechanism to shear ram 4B.

Notice that shearing is not possible if a tool-joint or heavy wall OCTG is in the shear rams although the need to seal-off the well is still the same. This may be overcome by: the use of two shear rams, also specified in API S53 (7.1.3.1.6). In the present invention, two shear rams would be spaced further apart than the [(longest tool-joint length)+(upset area length)] to assure that there is no tool joint in at least one of the shear rams. The AutoBOP would then activate only the shear ram to cut the body wall. In the event that nonshearable equipment is inside the shear rams, the AutoBOP adds a hammer operation to the operation of shear ram 4B. The hammer operation may be carried out through control of the hydraulic supply or through a motor or a combination thereof. It should be understood that the hammer operation will also require an actuator with higher operational pressure.

The corrective steps 1 through 4 may be implemented through computer 20 or through external control (such as an ROV) and may be carried out using the existing electrical and hydraulic connections of rig 1, BOP 4 batteries and accumulators, subsea connectors, similar items and combinations thereof.

In other embodiments, a system to arrest and control an elastically unstable slender column of material is provided that may comprise components such as but not limited to at least one computer with a sensor interface, at least one sensor to monitor parameters of the material inside the system, at least one ram with an accumulator, and/or a program being executed on the at least one computer to activate the at least one ram to control the column of material, the activation been partially controlled by the monitored parameters.

The parameters may comprise of wall thickness, imperfections, hardness, dimensions, wear, rate of wear, stress concentration, weight, lateral location, angle, similar items and a combination thereof.

The at least one computer may further comprise of a data acquisition system to monitor operation parameters of the system.

The operation parameters may comprise of one or more of capacitance, contactivity, current, deflection, density, external pressure, fluid volume, flow rate, frequency, impedance, inductance, internal pressure, length, accumulator pressure, resistance, sound, temperature, vibration, voltage, similar items and combinations thereof.

The activation may be partially controlled responsively to the monitored operation parameters.

Another embodiment may comprise a system to arrest and control an elastically unstable slender column of OCTG. The system may comprise of but is not limited to at least one computer, a data acquisition system to monitor operational parameters of the system, at least one ram with a accumulator, and/or a program being executed on the at least one computer to activate the at least one ram to control the column of OCTG. The activation may be partially controlled in response to the monitored operational parameters.

The operation parameters may comprise of one or more of capacitance, contactivity, current, deflection, density, external pressure, fluid volume, flow rate, frequency, impedance, inductance, internal pressure, length, accumulator pressure, resistance, sound, temperature, vibration, voltage, similar items and combinations thereof.

The at least one computer of may further comprise of a sensor interface to monitor parameters of the material inside the system.

The material parameters may comprise of wall thickness, imperfections, hardness, dimensions, wear, rate of wear, stress concentration, weight, lateral location, angle, similar items and/or a combination thereof.

The activation may be partially controlled responsively to the monitored material parameters.

In another embodiment, a constant-vigilance well-monitoring system may comprise of but is not limited to at least one computer, at least one sensor operable by the at least one computer to monitor at least one operational parameter of the well and a program being executed on the at least one computer to process the at least one operational parameter to determine a status of the well.

The operation parameters may comprise of one or more of acceleration, angle, capacitance, contactivity, current, deflection, deformation, density, dimension, field, flow rate, fluid volume, frequency, GPS, hardness, impedance, imperfection, inductance, intensity, length, light, location, motion, pressure, resistance, sound, speed, temperature, vibration, voltage, wall thickness, imperfections, weight, similar items and combinations thereof.

The at least one computer may further control excitation for the at least one sensor, which may or may not also comprise pipe magnetization.

The well-monitoring system may further comprise of at least one valve under the control of the at least one computer. The at least one valve may be capable of reducing the cross-sectional-area of the annulus of the well. The at least one valve may be capable of diverting the flow of the well.

The system whereby the activation may be partially controlled responsively to the monitored material parameters.

In yet another embodiment, a system to monitor hydrocarbon well conditions may comprise various status features comprising the rig crew is in control; the rig is functioning; the rig provides the drill pipe controlling force; the drill string is straight and under tension; the drill pipe is near the center of the BOP; the rig crew may position a drill pipe body-wall inside the shear rams; the drill string is static; the well is not flowing or the flow is under the control of the rig crew; the BOP sequencing, like the EDS sequence, may be programmed and carried-out automatically; and there is no life-threatening urgency to complete the task.

The parameters may comprise of wall thickness, imperfections, hardness, dimensions, wear, rate of wear, stress concentration, weight, lateral location, angle, similar items and a combination thereof.

In general, it will be understood that such terms as "up," "down," "vertical," "upper", "lower", "above", "below", and the like, are made with reference to the drawings and/or the earth and that the devices may not be arranged in such positions at all times depending on variations in operation, transportation, mounting, and the like. As well, the drawings are intended to describe the concepts of the invention so that the presently preferred embodiments of the invention will be plainly disclosed to one of skill in the art but are not intended to be manufacturing level drawings or renditions of final products and may include simplified conceptual views as desired for easier and quicker understanding or explanation of the invention. One of skill in the art upon reviewing this specification will understand that the relative size and shape of the components may be greatly different from that shown and the invention can still operate in accord with the novel principals taught herein. While inner and outer seals are created as shown above, only an inner or outer seal might be created in accord with the present invention.

Accordingly, because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative of a presently preferred embodiment and not in a limiting sense.

Related applications U.S. Provisional Patent Application Ser. No. 62/151,627 filed Apr. 23, 2015, and U.S. application Ser. No. 15/134,745 filed Apr. 21, 2016 are incorporated by reference.

The invention claimed is:

1. A monitoring system for a subsea BOP, said subsea BOP defining a bore through said subsea BOP, said subsea BOP comprising a ram, said monitoring system comprising:

a computer;

programming on said computer to control an activation timing of said subsea BOP; and a sensor mounted to said subsea BOP wherein said programming on said computer is operable to utilize signals from said sensor to make a calculation of whether said ram is able to cut an object in said subsea BOP.

2. The monitoring system of claim 1, further comprising a vertical axis through said subsea BOP, said sensor comprising plurality of sensors spaced along said vertical axis.

3. The monitoring system of claim 1, wherein said object comprises a pipe connector and a pipe body, and wherein said programming on said computer calculates whether said ram is able to cut said pipe body but is not able to cut said pipe connector, said programming also utilizing said sensor to determine when said pipe body is in a position to be cut by said ram.

4. The monitoring system of claim 1, further comprising:

a sensor subsea interface;

a communications link; and wherein said programming on said computer is operable to monitor a plurality of material parameters of said object inside said subsea BOP.

5. The monitoring system of claim 4, wherein said object is a pipe and said plurality of material parameters comprises a wall thickness of said pipe.

6. The monitoring system of claim 1 wherein said programming is operable to classify said object in said bore as a motors, drill bits, motors, drill bits, bottom hole assembly components, heavy weight pipe, wireline, monitoring equipment, tools, tools, production tools or other components.

7. The monitoring system of claim 6, wherein said computer comprises a subsea computer, at least one accumulator further comprising at least one valve controlled by said subsea computer.

8. The monitoring system of claim 1, wherein said programming allows closing of said ram only when said ram is capable of cutting said object.

9. The monitoring system of claim 8, wherein said .programming allows closing of said ram when said object is in a position that cutting of said object is possible with said ram.

10. The monitoring system of claim 9, wherein said object comprises a pipe body and a connector, said programming determines that said pipe body rather than said connector is in a position that cutting said pipe body is possible with said ram.

11. The monitoring system of claim 1, further comprising said sensor comprising a plurality of sensors being positioned outside of said bore through said subsea BOP.

12. The monitoring system of claim 1, further comprising, said sensor comprising a plurality of groups of sensors where each group of said plurality of groups of sensors is axially spaced at different axial positions with respect to said bore of said subsea BOP.

13. The monitoring system of claim 1, said programming on said computer being operable to determine a speed and direction of an object moving through said subsea BOP.

14. The monitoring system of claim 1, wherein said object moving through said subsea BOP comprise tool joints moving through said subsea BOP.

15. The monitoring system of claim 1, wherein said object moving through said subsea BOP comprise at least one of a string of pipe, a downhole tool, tool joint, drill bit, heavy-weight drill pipe, pipe body section. motor, bottom hole assembly components, motors, drill bits, wireline, monitoring equipment, tools, or other cornponents.

16. The monitoring system of claim 1, wherein said computer is a subsea computer, and wherein said object is a string of pipe, and wherein said programming is operable to control a timing to initiate cutting said string of pipe independently from surface signals after blowout conditions are detected.

17. The monitoring system of claim 16, wherein said programming is operable to control said timing for at least two BOP rams and to control which of said at least two BOP rams to operate first.

18. The monitoring system of claim 1, wherein said programming is operable to utilize signals from said sensor to provide an alert to a surface position that well control has been at least potentially compromised.

19. The monitoring system of claim 1, wherein said sensor comprises one or more sensors that provide a signal to detect one or more of wall thickness, pipe imperfections, hardness, dimensions, wear, stress concentration, weight, lateral location of pipe that is offset from a vertical centerline of said BOP or a or proximity to a BOP internal wall, an angle of a pipe within said BOP with respect to said vertical centerline of said BOP, RFID information, speed and position of a piston rod, a speed and position of a piston, or speed and position of a said ram, an electromagnetic field, capacitance, contactivity, current, deflection, density, external pressure, fluid volume, flow rate, frequency, impedance, inductance, internal pressure, length, rate, accumulator pressure, pressure, resistance, sound, temperature, vibration, voltage, drill pipe internal pressure, a temperature gradient between seawater and well fluids, compression or tension of a body wall of a string of pipe inside said BOP, flow of fluid through the string of pipe, a change in the shear force to cut said string of pipe or a combination of the above.

* * * * *